US007162181B2

(12) United States Patent
Maeshima et al.

(10) Patent No.: US 7,162,181 B2
(45) Date of Patent: Jan. 9, 2007

(54) REMANUFACTURING METHOD FOR PROCESS CARTRIDGE

(75) Inventors: Hideki Maeshima, Mishima (JP); Kanji Yokomori, Odawara (JP); Kazunari Murayama, Shizuoka-ken (JP); Susumu Nittani, Shizuoka-ken (JP); Nobuharu Hoshi, Numazu (JP); Tatsuya Suzuki, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 10/878,737

(22) Filed: Jun. 29, 2004

(65) Prior Publication Data

US 2005/0115043 A1 Jun. 2, 2005

(30) Foreign Application Priority Data

Nov. 28, 2003 (JP) ..... 2003-400822

(51) Int. Cl.
*G03G 15/00* (2006.01)
*G03G 21/18* (2006.01)

(52) U.S. Cl. ..... 399/109; 399/111

(58) Field of Classification Search ..... 29/402.08; 399/109, 111, 113

See application file for complete search history.

(56) References Cited

U.S. PATENT DOCUMENTS

| | | | | |
|---|---|---|---|---|
| 5,634,178 | A | 5/1997 | Sugiura et al. | 399/110 |
| 5,839,028 | A | 11/1998 | Nomura et al. | 399/109 |
| 5,878,309 | A | 3/1999 | Nomura et al. | 399/111 |
| 5,950,049 | A | 9/1999 | Yokomori et al. | 399/119 |
| 5,953,562 | A | 9/1999 | Kawaguchi et al. | 399/117 |
| 5,966,566 | A | 10/1999 | Odagawa et al. | 399/109 |
| 6,029,031 | A | 2/2000 | Yokomori et al. | 399/109 |
| 6,072,969 | A | 6/2000 | Yokomori et al. | 399/119 |
| 6,078,763 | A | 6/2000 | Hoshi | 399/111 |
| 6,215,969 | B1 | 4/2001 | Nomura et al. | 399/111 |
| 6,266,503 | B1 | 7/2001 | Murayama et al. | 399/117 |
| 6,289,189 | B1 | 9/2001 | Numagami et al. | 399/111 |
| 6,381,430 | B1 | 4/2002 | Yokomori et al. | 399/119 |
| 6,459,869 | B1 | 10/2002 | Nittani et al. | 399/111 |
| 6,473,577 | B1 | 10/2002 | Higeta et al. | 399/109 |
| 6,643,481 | B1 | 11/2003 | Higeta et al. | 399/109 |
| 6,963,706 | B1 | 11/2005 | Morioka et al. | 399/111 |
| 2002/0054771 | A1 | 5/2002 | Higeta et al. | 399/109 |
| 2003/0133723 | A1 | 7/2003 | Fujita et al. | 399/111 |

(Continued)

FOREIGN PATENT DOCUMENTS

EP 1 152 300 A2 11/2001

(Continued)

OTHER PUBLICATIONS

Jan. 5, 2006 Korean Office Action in Appln. No. 000706667.

*Primary Examiner*—William J. Royer
(74) *Attorney, Agent, or Firm*—Fitzpatrick, Cella, Harper & Scinto

(57) ABSTRACT

A process cartridge remanufacturing method including the steps of: separating photosensitive drum and developing units; dismounting a first side cover member; a dismounting a first gear group from a first bearing member; dismounting a supporting member from the first bearing member; dismounting a second gear group from the first bearing member; dismounting the first bearing member; dismounting a developing roller; dismounting a developing blade; filling a developer into a developer accommodating portion; mounting the developing blade; mounting the developing roller; mounting the second gear group, mounting the supporting member; mounting the first gear group; mounting the first side cover member; and rotatably connecting the photosensitive drum and developing units.

11 Claims, 18 Drawing Sheets

U.S. PATENT DOCUMENTS

| | | | | |
|---|---|---|---|---|
| 2003/0156855 | A1 | 8/2003 | Nittani et al. | 399/106 |
| 2003/0161654 | A1 | 8/2003 | Yokomori et al. | 399/111 |
| 2004/0013446 | A1 | 1/2004 | Morioka et al. | 399/111 |

FOREIGN PATENT DOCUMENTS

| | | | |
|---|---|---|---|
| EP | 1 168 109 | A2 | 1/2002 |
| EP | 1 253 486 | A2 | 10/2002 |
| JP | 8-82997 | A | 3/1996 |
| JP | 10-74031 | | 3/1998 |
| JP | 2000-75661 | A | 3/2000 |
| JP | 2001-125467 | A | 5/2001 |
| JP | 2002-49291 | A | 2/2002 |
| JP | 2002-189401 | A | 7/2002 |
| JP | 2003-307931 | A | 10/2003 |
| KR | 2001-100928 | | 11/2001 |

REMANUFACTURING METHOD FOR PROCESS CARTRIDGE

FIELD OF THE INVENTION AND RELATED ART

The present invention relates to a method for remanufacturing a process cartridge removably mountable in the main assembly of an electrophotographic image forming apparatus.

Here, an electrophotographic image forming apparatus is an apparatus for forming an image on recording medium, with the use of one of the electrophotographic image formation processes. For example, it includes an electrophotographic copying machine, an electrophotographic printer (for example, a laser beam printer, an LED printer, etc.), an electrophotographic facsimile apparatus, etc.

A process cartridge is a cartridge in which a minimum of a developing means as a processing means, and an electrophotographic photosensitive member are integrally disposed, and which is removably mountable in the main assembly of an electrophotographic image forming apparatus.

In the field of an electrophotographic image forming apparatus employing one of the electrophotographic image formation processes, it has been a common practice to employ a process cartridge system, which integrally places an electrophotographic photosensitive member, and a single or plurality of processing means which act on an electrophotographic photosensitive member, in a cartridge removably mountable in the main assembly of an electrophotographic image forming apparatus. The employment of this process cartridge system makes it possible for a user himself to maintain an electrophotographic image forming apparatus, without help from service personnel, drastically improving the apparatus in operational efficiency. Thus, a process cartridge system has been widely used in the field of an electrophotographic image forming apparatus.

A process cartridge is for forming an image on recording medium with the use of developer. Therefore, developer is consumed as an image is formed. Thus, as the amount of the developer in a process cartridge is reduced by the consumption to the level at or below which the process cartridge cannot form an image satisfactory in quality to a user who purchased the process cartridge, the process cartridge loses its commercial value; its service life ends.

A simple method for remanufacturing a process cartridge, the service life of which has expired due to the depletion of the developer therein, into a marketable process cartridge, has long been desired, and there have been devised a few such remanufacturing methods (U.S. Pat. No. 5,966,566).

SUMMARY OF THE INVENTION

The primary object of the present invention is to provide a simple method for remanufacturing a process cartridge.

Another object of the present invention is to provide a process cartridge remanufacturing method in which a second group of gears, with which the development unit of the cartridge is provided, does not fall off during the disassembly or assembly of the cartridge.

Another object of the present invention is to provide a process cartridge remanufacturing method which does not require a process cartridge to be restricted in attitude during the disassembly or assembly of the process cartridge.

Another object of the present invention is to provide a process cartridge remanufacturing method for remanufacturing a process cartridge which is removably mountable in the main assembly of an electrophotographic image forming apparatus, and which comprises: a photosensitive drum unit for supporting an electrophotographic photosensitive drum; and a development unit which supports a development roller for developing an electrostatic latent image formed on the electrophotographic photosensitive drum, and has the developer storage portion for storing the developer used, along with the development roller for developing the electrostatic latent image, and a developer delivery hole for supplying the development roller with the developer stored in the developer storage portion, and which is connected to the photosensitive drum unit so that the photosensitive drum unit and development unit are rotatable about the axial lines of members connecting the two units. The method comprises:

(a) a unit separation process for separating the photosensitive drum unit and development unit from each other;

(b) a first end cover removal process for removing a first end cover attached to the first lengthwise end of the separated development unit;

(c) a first gear group removal process for removing a first group of gears attached to a first bearing member 76 attached to the first lengthwise end of a development unit main frame 27, the first group of gears including the driving force reception gear for receiving a driving force from the main assembly of an image forming apparatus when the process cartridge is in the main assembly of the image forming apparatus;

(d) a supporting member removal process for removing a supporting member from the first bearing member, after the removal of the first group of gears, the supporting member being located between the first group and a second group of gears in terms of the lengthwise direction of the development unit main frame, in order to support the second group of gears, and the second group of gears being located inward of the driving force reception gear, in terms of the lengthwise direction of the development unit main frame, in order to transmit the driving force they receive to a developer supply roller for supplying the development roller with the developer;

(e) a second gear group removal process for removing the second group of gears from the first bearing member;

(f) a first bearing member removal process for removing the first bearing member attached to the development unit frame, from the development unit main frame;

(g) a development roller removal process for removing the development roller from the development unit frame;

(h) a development blade removal process for removing the development blade, for regulating the amount of developer allowed to remain adhered to the peripheral surface of the development roller, from the development unit main frame;

(i) a developer refill process for refilling the developer storage portion with developer, through the developer delivery hole exposed by the removal of the development blade;

(j) a development blade attachment process for attaching the development blade to the development unit main frame;

(k) a development roller attachment process for attaching the development roller to the development unit main frame by fitting an end portion of a shaft of the development roller into a second hole of a second bearing member attached to the development unit main frame, fitting on the other end portion of the shaft of the development roller into another hole **76*a*** of the first bearing member, and attaching the first bearing member to the development unit main frame;

(l) a second gear group attachment process for attaching the second group of gears to the first bearing member attached to one of the lengthwise ends of the development unit main frame;

(m) a supporting member attachment process for attaching the supporting member to the first bearing member, to which the second group of gears is attached, in such a manner that the supporting member at least partially overlaps with the second group of gears, and also, that the supporting member is positioned outward of the second group of gears in terms of the lengthwise direction of the development unit main frame;

(n) a first gear group attachment process for attaching the first group of gears to the first bearing member, to which the supporting member has been attached, in such a manner that the first group of gears is positioned outward of the supporting member in terms of the lengthwise direction of the development unit main frame;

(o) a first end cover attachment process for attaching the first end cover to the first bearing member, with the interposition of the supporting member, so that a part of the first end cover is placed in contact with the supporting member in a manner to keep the supporting member pressed on the first bearing member, with the first end cover being accurately positioned relative to the first bearing member by the fitting of positioning projections of the first bearing member into positioning holes of the first end cover; and (p) a photosensitive drum unit and development unit connection process for connecting the photosensitive drum unit and development unit in such a manner that the two units are rotatable about the axial lines of the members connecting the two units.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

[Description of General Structure of Image Forming Apparatus]

Figure 1:
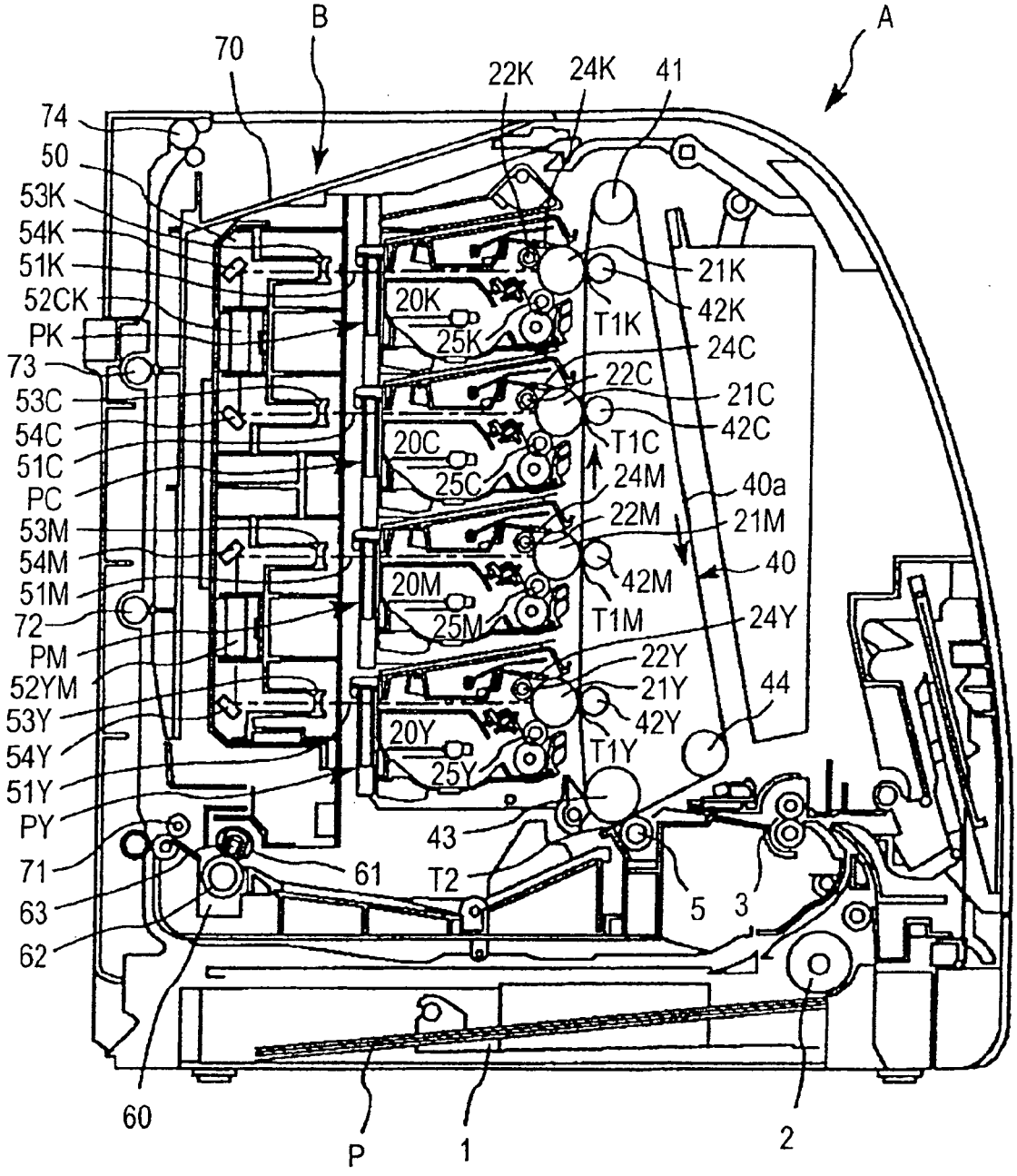
FIG. 1 is a sectional view of the image forming apparatus in one of the preferred embodiments of the present invention, showing the general structure thereof.

First, referring to FIG. 1, a color image forming apparatus as an example of an image forming apparatus in which a process cartridge is removably mountable will be roughly described regarding its general structure. The color image forming apparatus in this embodiment is a color laser printer.

In this embodiment, the color laser printer A has four image formation stations PY, PM, PC, and PK, which employ yellow Y, magenta M, cyan C, and black B process cartridges 20 (20Y, 20M, 20C, 20K), respectively, and has an intermediary transfer unit 40 for temporarily holding a color image formed through multilayer transfer of a plurality of visible images (image formed of toners), as shown in FIG. 1. The four process cartridges 20 are individually and removably mountable in the main assembly B of the printer.

Figure 2:
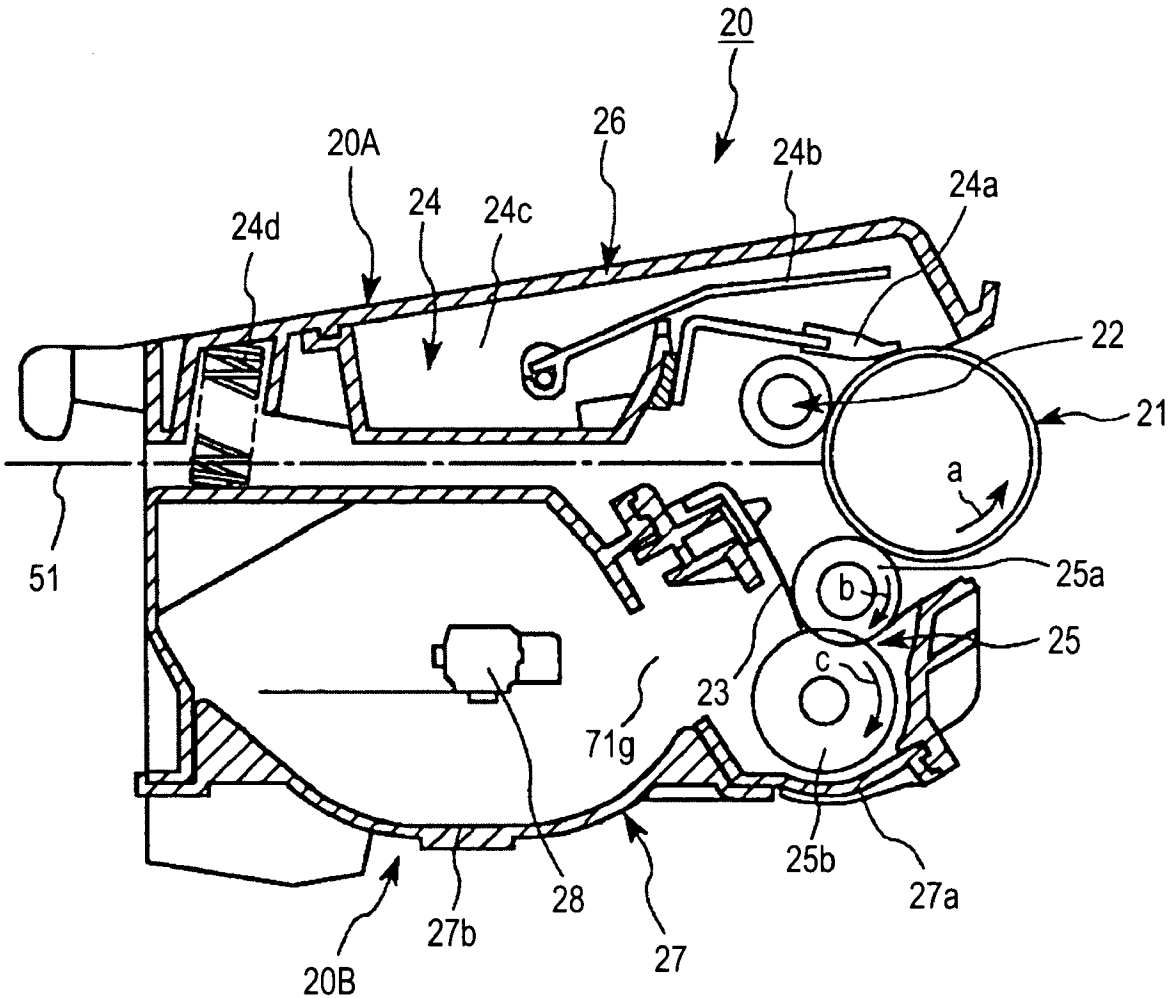
FIG. 2 is a sectional view of a process cartridge, showing the structure thereof.

Referring to FIG. 2, each process cartridge 20 (20Y, 20M, 20C, and 20K) is provided with an electrophotographic photosensitive drum 21 (21Y, 21M, 21C, and 21K) (which hereinafter will be described simply as "photosensitive drum") which is rotated at a predetermined peripheral velocity, a charging means 22 (22Y, 22M, 22C, and 22K), a developing means 25 (25Y, 25M, 25C, and 25K), and a cleaning means 24 (24Y, 24M, 24C, and 24K). A process cartridge 20 forms a toner image on the photosensitive drum 21. An exposing means 50 is a part of the main assembly B of the apparatus. The unit 40 conveys the color toner images, which the unit 40 is holding, to the transfer station, in which the color toner images are transferred onto a recording medium P conveyed from a recording medium feed station.

After the transfer of the toner images onto the recording medium P, the recording medium P is conveyed to the fixation station 60, in which the toner images are fixed to the recording medium P. Thereafter, the recording medium P is discharged by a group of discharge roller pairs 71, 72, 73, and 74, into the delivery tray 70 which constitutes a part of the top surface of the apparatus main assembly B.

Next, the various portions of the above described image forming apparatus will be described in detail regarding their structures, in the relevant order.

[Process Cartridge]

First, the structure of the process cartridge 20 (20Y, 20M, 20C, and 20K) will be roughly described. The cartridges 20Y, 20M, 20C, and 20K are the same in structure.

FIG. 2 is a sectional view of the cartridge 20. The cartridge 20 contains developer (toner), the amount of which is reduced by image formation, the photosensitive drum 21, and processing means such as a charge roller 22 as the charging means, a development roller 25*a* as the developing means 25, etc., making it possible to replenish the apparatus main assembly B with a fresh supply of developer, and/or replace together these processing means, by replacing the cartridge 20. The photosensitive drum 21, charging means 22, and developing means 25 will be described later in detail.

In other words, as the cartridge 20 runs out of toner, it is replaced, providing thereby the image forming apparatus with new processing components. Therefore, a high level of image quality is maintained.

The full-color image forming apparatus in this embodiment is of the in-line type, and employs four process cartridges, that is, yellow Y, magenta M, cyan C, and black B process cartridges 20 (20Y, 20M, 20C, 20K), which are different in the color of the developer they contain, and independent from each other, making it possible to individually replace the cartridges 20. Therefore, the four cartridges, which become different in the length of service life, depending upon what kind of images are outputted by the image forming apparatus, can be more efficiently used.

Figure 3:
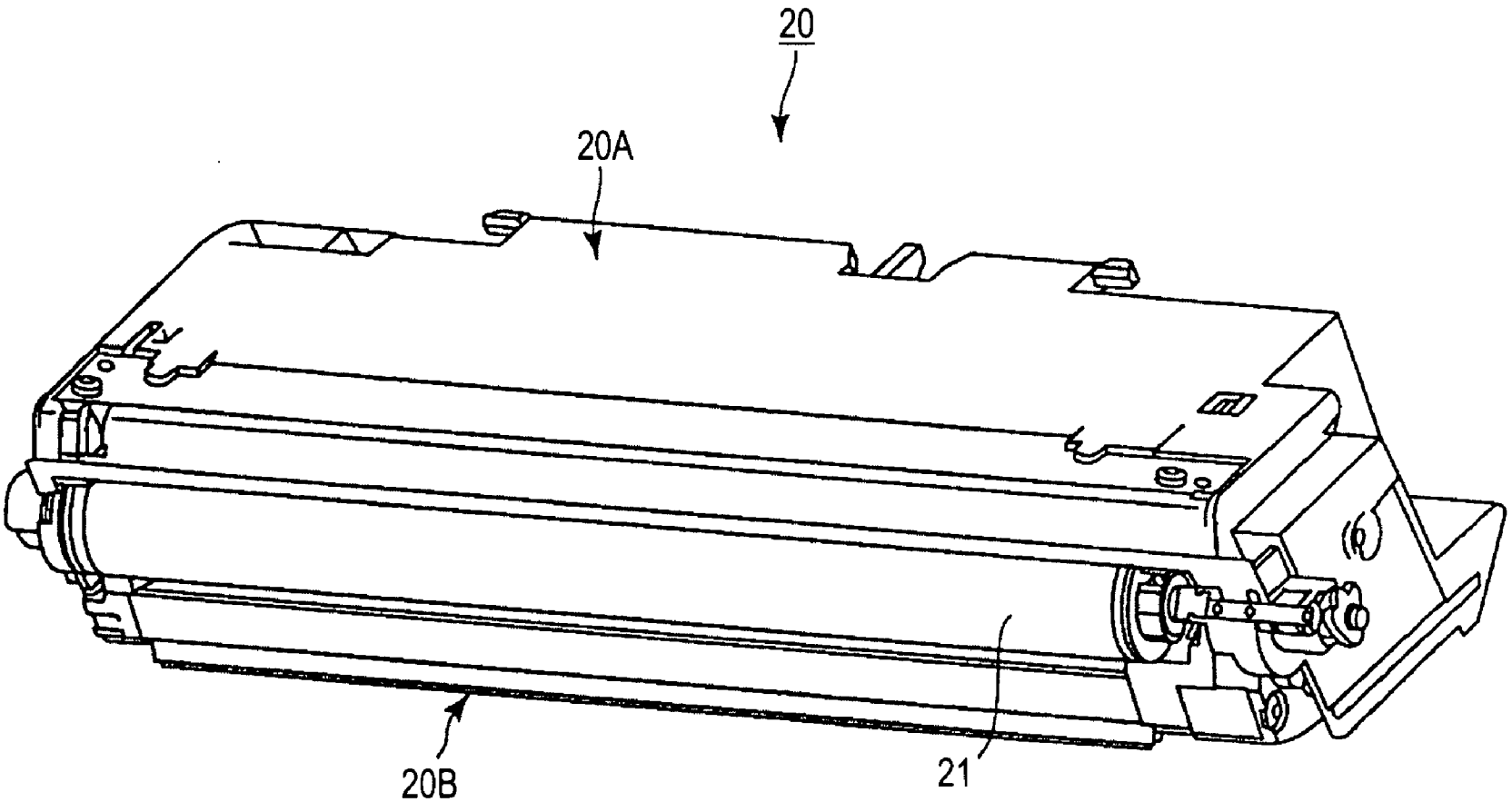
FIG. 3 is a schematic perspective view of a process cartridge, showing the entirety thereof.
Figure 4:
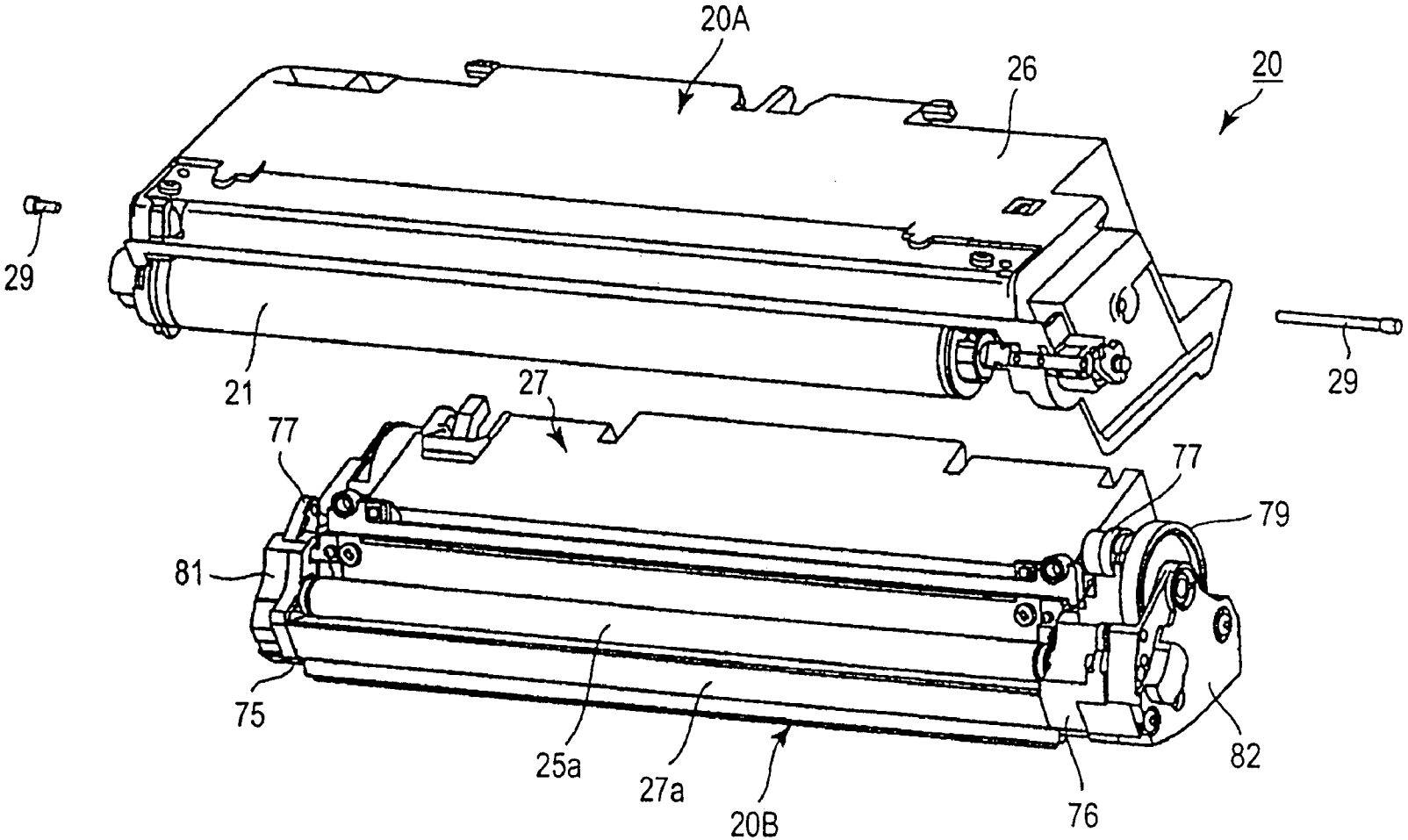
FIG. 4 is a schematic perspective view of a process cartridge, the photosensitive drum unit and development unit which are separated from each other.

Next, referring to FIGS. 3 and 4, the cartridge 20 (20Y, 20M, 20C, and 20K) in the preferred embodiment of the present invention will be described. FIG. 3 is a schematic perspective view of the cartridge 20, and FIG. 4 is a schematic perspective view of the partially disassembled cartridge 20. Incidentally, the yellow Y, magenta M, cyan C, and black K cartridges 20Y, 20M, 20C, and 20K are identical in structure.

The cartridge 20 is separable into a photosensitive drum unit 20A (which hereinafter will be referred to simply as "drum unit 20A") and a development unit 20B. The drum unit 20A comprises the photosensitive drum 21, charging means 22, and cleaning means 24. The development unit 20B comprises the developing means 25 for developing an electrostatic latent image formed on the photosensitive drum 21.

The drum unit 20A has a drum frame 26, to which the electrophotographic photosensitive drum 21 is rotatably attached, with the interposition of a pair of bearings (unshown). In the adjacencies of the peripheral surface of the photosensitive drum 21, the charge roller 22 as the primary charging means for uniformly charging the peripheral surface of the photosensitive drum 21, and a cleaning blade 24*a* for removing the residual developer (toner), that is, the developer (toner) remaining on the peripheral surface of the photosensitive drum 21, are disposed. The residual toner removed from the peripheral surface of the photosensitive drum 21 by the cleaning blade 24*a*, is sent by a toner conveying mechanism 24*b* to a waste toner chamber 24*c* located in the rear portion of the drum frame 26.

The photosensitive drum 21 is rotated in the counterclockwise direction (indicated by arrow mark a in FIG. 2) by a motor (unshown) in synchronism with the progression of an image forming operation.

The development unit 20B has a frame 27 which constitutes the development unit main frame. The development unit main frame 27 has a developing means container 27*a* which holds the development roller 25*a*, which is rotated in the direction indicated by an arrow mark b, in contact with the photosensitive drum 21, and a toner container 27*b*, that is, the developer storage portion, in which developer (toner) is stored.

The development roller 25*a* is rotatably supported by the developing means container 27*a*, with the interposition of a pair of bearing members 75 and 76. In the adjacencies of the peripheral surface of the development roller 25*a*, a developer (toner) supply roller 25*b* which is rotated in the direction indicated by an arrow mark c, in contact with the development roller 25*a*, and the development blade 23, are located.

In the toner container 27*b*, a stirring member 28 (which hereinafter may be referred to as "toner conveying member") for conveying the toner in the toner container 27*b* to the toner supply roller 25*b* while stirring the toner is disposed.

The development unit 20B is connected to the photosensitive drum unit 20A with the use of a pair of pins 29 inserted in the holes 77 of the bearing members 75 and 76 attached to the lengthwise ends of the development unit 20B, one for one, being enabled to oscillatorily move relative to the photosensitive drum unit 20A about the axial lines of the holes 77 (pins 29). Further, the development unit 20B is kept pressured by a pair of compression springs 24*d* so that the development roller 25*a* is kept in contact with the photosensitive drum 21 by the torque generated by the pair of compression springs 24*d* in the direction to rotate the development unit 20B about the axial lines of the holes 77 and pins 29.

[Electrophotographic Photosensitive Drum]

Each photosensitive drum 21 (21Y, 21M, 21C, 21K) comprises an aluminum cylinder, and a layer of organic photoconductive substance coated on the peripheral surface of the aluminum cylinder. The photosensitive drum 21 is placed in the drum frame 26, being supported by the drum frame 26. In other words, the drum unit 20A and the development unit 20B are integrally joined with each other, forming thereby the process cartridge 20.

Each cartridge 20 (20Y, 20M, 20C, and 20K) is removably supported by the printer main assembly B, being enabled to be easily replaced as the service life of the photosensitive drum 21 therein expires, or the developer therein is depleted.

The method for attaching the photosensitive drum 21 in this embodiment of the present invention, and the matter related thereto, will be described later.

[Charging Means]

The charge roller 22 (22Y, 22M, 22C, and 22K) as a charging means is of a contact type. That is, the charge roller 22 is an electrically conductive roller, and is placed in contact with the peripheral surface of the photosensitive drum 21, so that as voltage is applied to the charge roller 22, the peripheral surface of the photosensitive drum 21 is uniformly charged.

[Exposing Means]

Referring to FIG. 1, the process for exposing the photosensitive drum 21 is carried out by a scanner as an exposing means 50.

The scanner in this embodiment has two polygon mirrors (52YM and 52CK) although the image forming apparatus is provided with the four image formation stations PY, PM, PC, and PK. As image formation signals are sent to a laser diode, the laser diode projects a beam of image formation light 51 (51Y, 51M, 51C, and 51K) modulated with the image formation signals, to the polygon mirrors (52YM and 52CK), which are being rotated at a high speed, and deflect (reflect) the beam of image formation light 51. The beam of image formation light 51 deflected by the polygon mirrors 51 is changed in direction by a deflection (reflection) mirror (54Y, 54M, 54C, and 54K), travels through the focal lens (53Y, 53M, 53C, and 53K), and selectively exposes the numerous points of the peripheral surface of the photosensitive drum 21 (21Y, 21M, 21C, and 21K) which is being rotated at a predetermined peripheral velocity. As a result, an electrostatic latent image is formed on the photosensitive drum 21.

[Developing Means]

The developing means 25 (25Y, 25M, 25C, and 25K) stores in its toner container 27*b* the color developer (toner) for developing an electrostatic latent image on the photosensitive drum 21, into a visible image, as described above.

During a developing operation, the stored developer is conveyed by the toner conveying member 28 to the toner supply roller 25*b*, which is being rotated in the direction (indicated by arrow mark c), with its peripheral surface being kept in contact with the peripheral surface of the development roller 25*a*. As a result, the two surfaces rub against each other, causing thereby the developer on the peripheral surface of the toner supply roller 25*b* to transfer onto the peripheral surface of the development roller 25*a* to be borne thereon.

As the development roller 25*a* is rotated, the toner borne on the development roller 25*a* reaches the development blade 23, which regulates the amount of toner that is allowed to remain adhered to the peripheral surface of the development roller 25*a*, while giving the toner a desired amount of electrical charge. As a result, the toner on the peripheral surface of the development roller 25*a* is formed into a thin layer with a predetermined thickness. As the development roller 25*a* is further rotated, the thin layer of toner is conveyed to the development station, in which the peripheral surfaces of the photosensitive drum 21 and development roller 25*a* are in contact with each other, and in which the toner is made to move from the development roller 25*a* onto the photosensitive drum 21, by the development bias (DC voltage) applied to the development roller 25*a* from a power source (unshown). As a result, the latent image on the photosensitive drum 21 is turned into a visible image (toner image, or image formed of toner).

The toner remaining on the peripheral surface of the development roller 25*a* is rubbed away from the peripheral surface of the development roller 25*a* by the toner supply roller 25*b*, and is recovered into the developing means container, in which it is mixed into the main body of the toner in the developing means container.

In the case of a contact type developing method, that is, a developing method in which the photosensitive drum 21 and development roller 25*a* are kept in contact with each other as they are in this embodiment, it is desired that the photosensitive drum 21 is rigid, whereas the development roller 25*a* is provided with an elastic layer. As this elastic layer, a single layer of solid rubber, a combination of a layer of solid rubber and a resin layer coated on the solid rubber layer in consideration of the charging of the toner, etc., are used.

[Intermediary Transfer Unit]

The intermediary transfer unit 40 comprising an intermediary transferring member 40*a* transfers in layers onto the intermediary transferring member 40*a* the toner images (visible images) formed on the photosensitive drums 21, one for one, by the developing means 25 during a color image forming operation. Thus, the intermediary transferring member 40*a* is rotated in the clockwise direction (indicated by arrow mark in FIG. 1) at the same peripheral velocity as that of the photosensitive drum 21.

The toner images formed on the photosensitive drums 21 are transferred onto the intermediary transferring member 40*a* in the primary transfer stations (T1Y, T1M, T1C, and T1K), which are the contact areas between the primary transfer rollers (42Y, 42M, 42C, and 42K) and intermediary transferring member 40*a*, respectively. Each transfer roller is positioned so that its peripheral surface is kept pressed against the peripheral surface of the photosensitive drum 21, with the transferring member 40*a* sandwiched between the two peripheral surfaces. Further, voltage is applied to the transfer roller.

After the multiple images are transferred in layers onto the intermediary transferring member 40*a*, the portion of the intermediary transferring member 40*a*, which is bearing the multiple images, is moved through the secondary transfer station T2, in which the intermediary transferring member 40*a* is kept in contact with a secondary transfer roller 5, along with a recording medium P, while keeping a recording medium P sandwiched between the intermediary transferring member 40*a* and transfer roller 5. As a result, the toner images, different in color, on the intermediary transferring member 40*a* are transferred all at once in layers onto the recording medium P.

In this embodiment, the intermediary transferring member 40*a* is stretched around three rollers (shafts), that is, a drive roller 41, a counter roller 43 (roller against which secondary transfer roller 5 is kept pressed), and a tension roller 44, being thereby supported by them. The tension roller 44 is kept pressured outward of the loop of the intermediary transferring member 40*a* by the pressure applied to the lengthwise end portions of the tension roller 44 by a pair of springs, so that even if the circumferential dimension of the intermediary transferring member 40*a* changes due to the changes in the temperature and/or humidity in the apparatus main assembly, and/or cumulative usage of the intermediary transferring member 40*a*, the changes in the tension of the intermediary transferring member 40*a* can be absorbed.

[Recording Medium Feeding Station]

The recording medium feed station is a station for feeding a recording medium P into the image formation station. The feed station comprises a cassette 1 storing a substantial number of recording media P, a feed roller 2, and a pair of registration rollers 3.

During an image forming operation, the feed roller 2 is rotationally driven in synchronism with the progression of the image forming operation, and the recording media P in the cassettes 1 are sequentially fed into the apparatus main assembly by the feed roller 2, while being separated. Then, each recording medium P is conveyed to the pair of registration rollers 3, which carries out, according to a predetermined sequence, the non-rotational operation, that is, the operation for keeping the recording medium P on standby, and the rotational operation, that is, the operation for releasing the recording medium P to allow the recording medium P to be conveyed toward the intermediary transferring member 40*a*. In other words, the pair of registration rollers 3 releases the recording medium P so that the recording medium P aligns with an image during the following process, that is, the image transfer process.

[Secondary Transfer Station]

The secondary transfer station T2 is provided with the secondary transfer roller 5 as described before.

The secondary transfer roller 5 is movable in position.

More specifically, the secondary transfer roller 5 is moved by a cam (unshown), in synchronism with the transfer of color images onto the recording medium P, into the top position in which it is kept pressed against the intermediary transferring member 40*a*, with the recording medium P sandwiched between the secondary transfer roller 5 and intermediary transferring member 40*a*. At the same time, transfer bias (voltage) is applied to the transfer roller 5. As a result, the toner images on the intermediary transferring member 40*a* are transferred onto the recording medium P.

The intermediary transferring member 40*a* and secondary transfer roller 5 are individually driven. Therefore, the recording medium P is conveyed in the leftward direction of the drawing, at a predetermined speed, while remaining pinched between the intermediary transferring member 40*a* and transfer roller 5 so that the toner images are transferred onto the recording medium P. Then, the recording medium P is further conveyed to the fixation station, in which the next process is carried out.

[Fixation Station]

The fixation station 60 is a station in which the toner images which have just been transferred onto the recording medium P are fixed. The fixation station 60 comprises: a film guide unit 61 containing a ceramic heater 63 for heating the recording medium P, and a pressure roller 62 for keeping the recording medium P pressed against the film guide unit 61.

Thus, the transfer medium P bearing the transferred toner images is conveyed by the film guide unit 61 and pressure roller 62, while heat and pressure are applied to the recording medium P. As a result, the toner images are fixed to the recording medium P.

[Image Forming Operation]

Next, the image forming operation carried out by the apparatus structured as described above will be described.

First, the feed roller 2 shown in FIG. 1 is rotated to separate one of the recording media P in the cassette 1 from the rest, and the separated recording medium P is conveyed to the pair of registration rollers 3.

Meanwhile, the photosensitive drum 21 and intermediary transferring member 40*a* are rotated (in the direction indicated by an arrow mark) at a predetermined peripheral velocity (process speed).

After the peripheral surface of the photosensitive drum 21 is uniformly charged by the charge roller 22, it is exposed to the aforementioned beam of exposure light 51. As a result, a latent image is formed on the peripheral surface of the photosensitive drum 21.

Then, the latent image is developed. The above described image formation steps are carried out to form yellow, magenta, cyan, and black images in the listed order. The formed yellow, magenta, cyan, and black toner images are transferred onto the intermediary transferring member 40*a* by the corresponding primary transfer rollers (42Y, 42M, 42C, and 42K), in the primary transfer stations (T1Y, T1M, TC1, and TK1), respectively. As a result, a full-color image made up of four different toners (yellow, magenta, cyan, and black toners) is formed on the surface of the intermediary transferring member 40*a*.

Before the end of the transfer of the black toner image onto the intermediary transferring member 40*a*, that is, before the leading edge of the full-color image, the formation of which is completed by the primary transfer of the fourth toner image, that is, the black toner image, reaches the secondary transfer station T2, the transfer medium P kept on standby by the above described pair of registration rollers 3 is released so that the transfer medium P arrives at the secondary transfer station T2 at the same time as the full-color image.

The transfer roller 5 kept on standby below the counter roller 15, being thereby kept away from the intermediary transferring member 40*a* while the aforementioned four toner images different in color are formed, is moved upward by the cam (unshown), pressing thereby the transfer medium P upon the intermediary transferring member 40*a*, in the transfer station T2. Then, bias opposite in polarity from the developer is applied to the secondary transfer roller 5. As a result, the full-color image formed of the four toner images different in color, on the intermediary transferring member 40*a*, is transferred onto the transfer medium P. After being conveyed through the transfer station T2, the transfer medium P is peeled away from the intermediary transferring member 40*a*, and conveyed to the fixation station 60, in which the toner images are fixed. Thereafter, the transfer medium P is discharged by the group of discharge roller pairs 71, 72, 73, and 74 onto the delivery tray 70 on top of the apparatus main assembly B, concluding the printing of a single copy.

[Structure of Development Unit]

Next, referring to FIGS. 5–14, the development unit 20B of the process cartridge 20 will be described.

Figure 5:
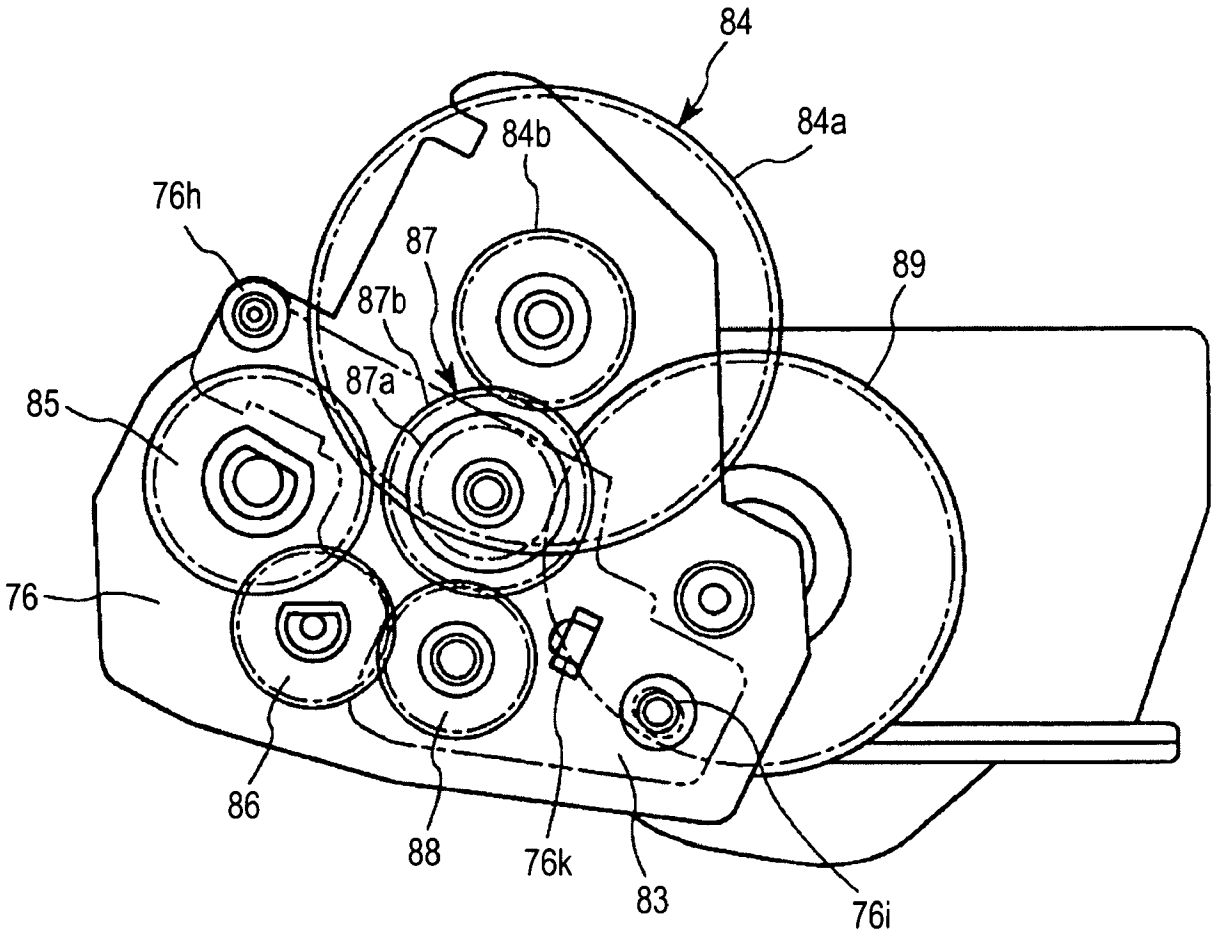
FIG. 5 is a schematic phantom side view of one of the lengthwise ends of the development unit.
Figure 6:
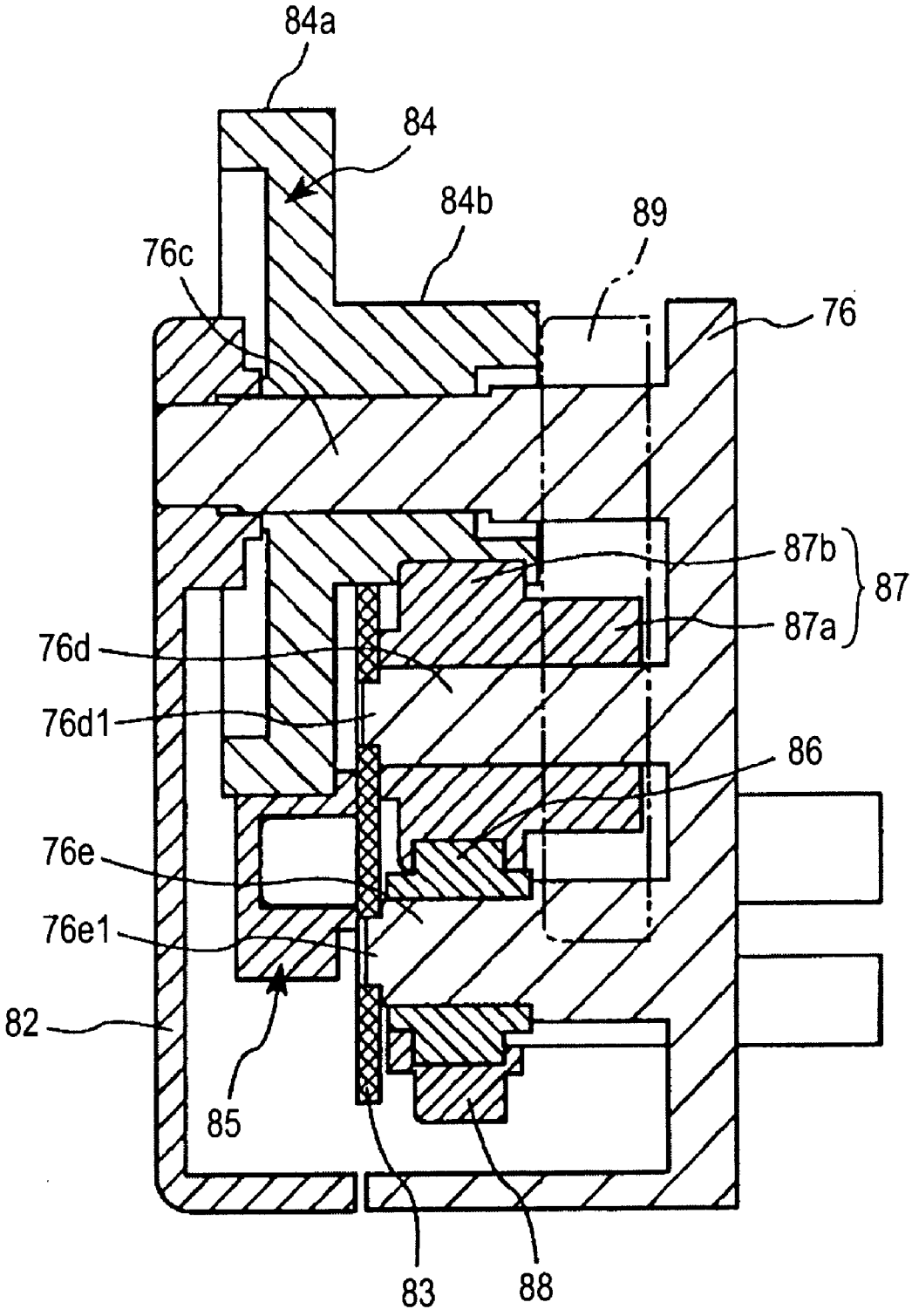
FIG. 6 is a schematic sectional view of the same lengthwise end of the development unit as the one shown in FIG. 5.
Figure 7:
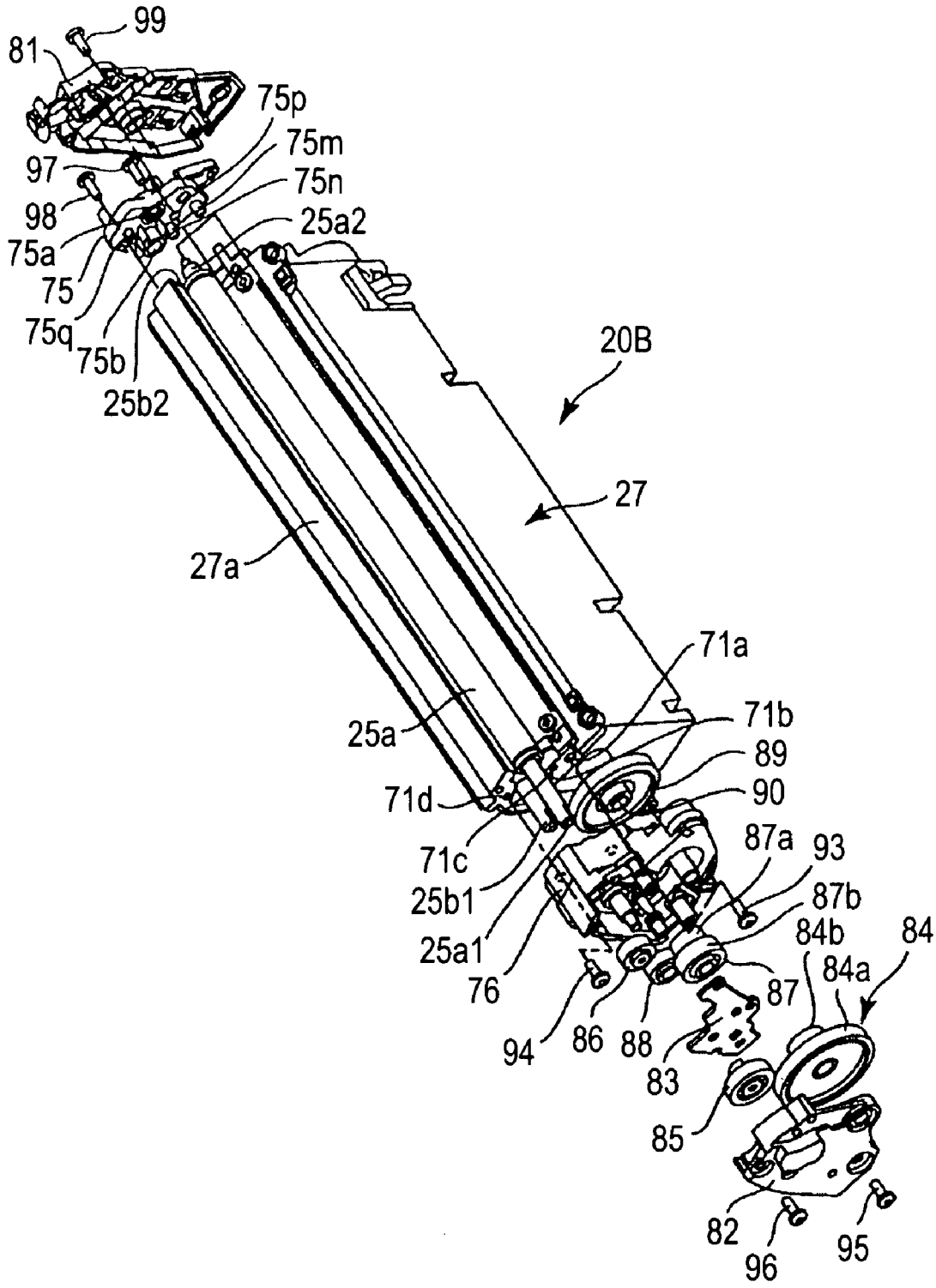
FIG. 7 is a schematic perspective view of the disassembled development unit, showing the general structure thereof.
Figure 8:
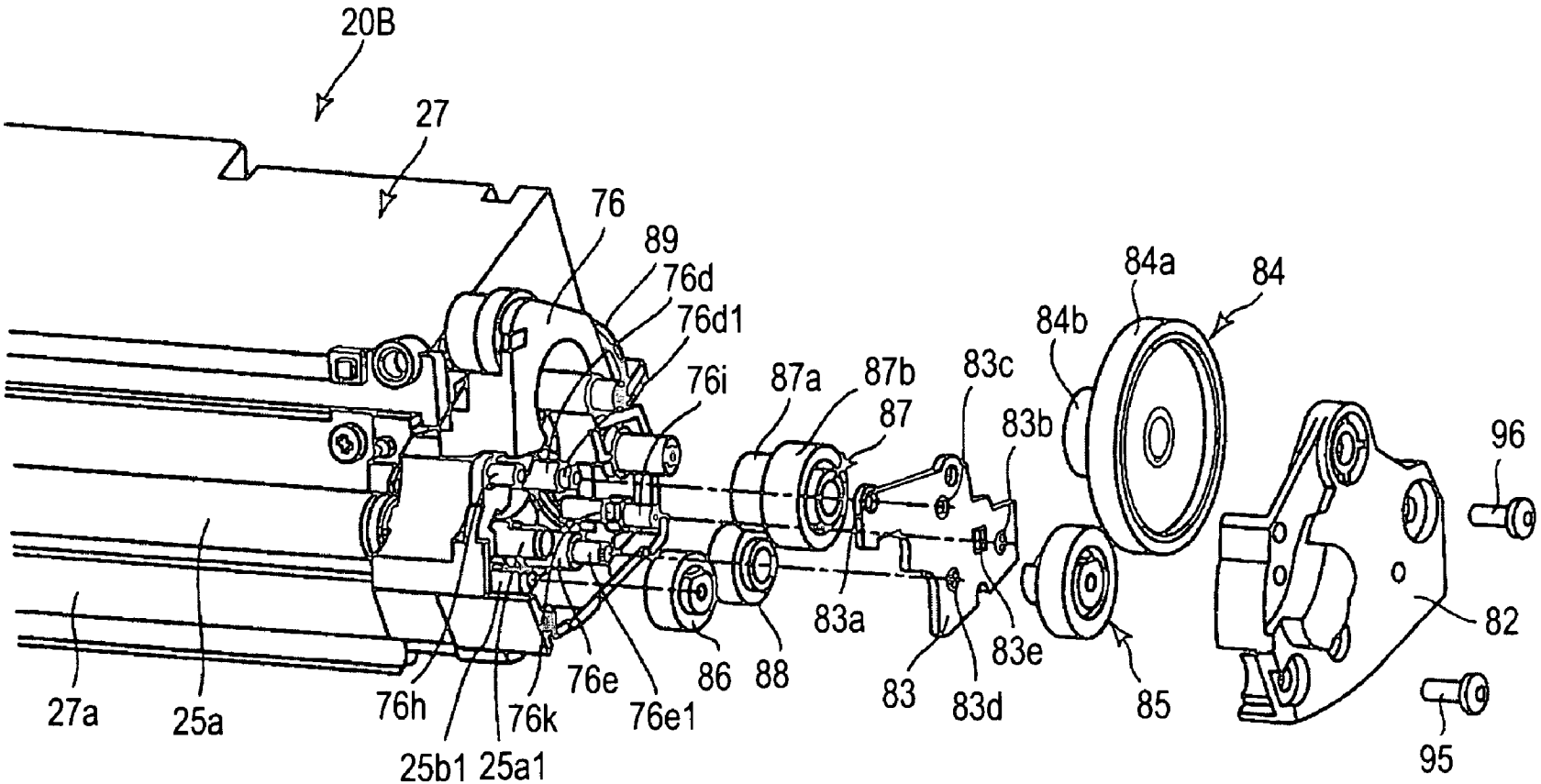
FIG. 8 is a schematic perspective view of the partially disassembled first lengthwise end of the development unit, after the attachment of the first bearing member.
Figure 9:
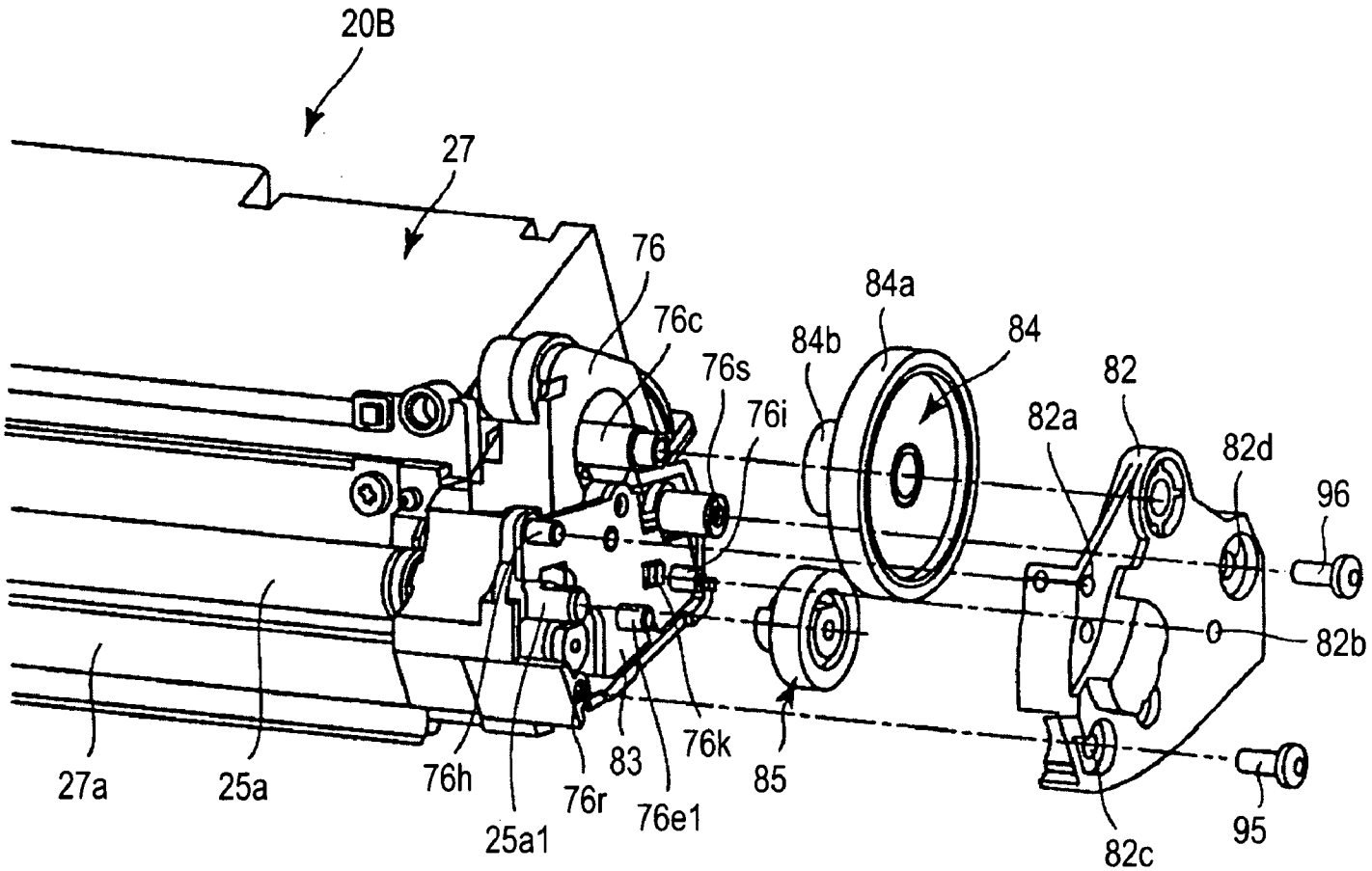
FIG. 9 is a schematic perspective view of the partially disassembled first lengthwise end of the development unit, prior to the removal, or after the attachment, of the regulating member.
Figure 10:
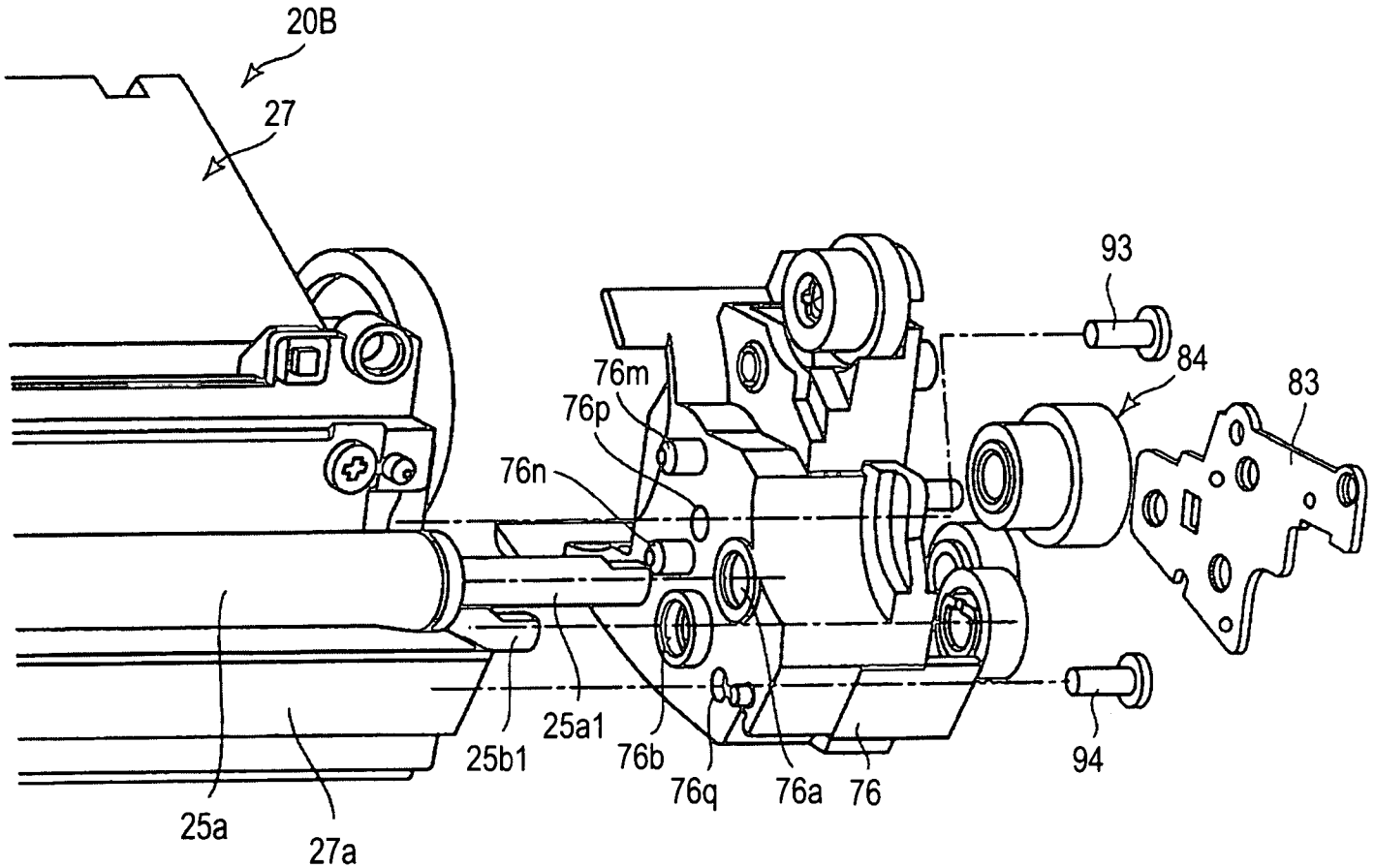
FIG. 10 is a schematic perspective view of the partially disassembled first lengthwise end of the development unit, prior to the removal, or after the attachment, of the regulating member.
Figure 11:
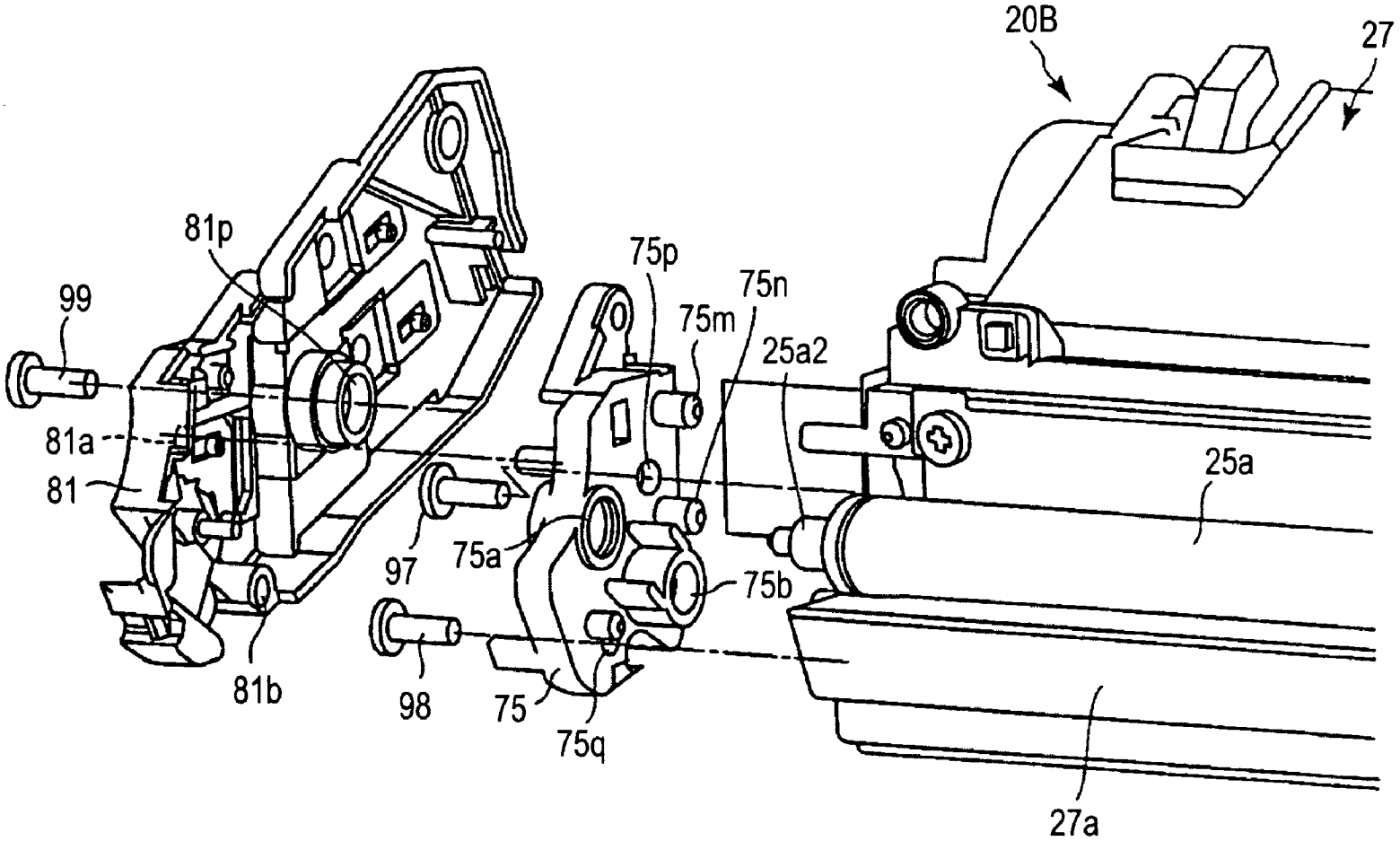
FIG. 11 is a schematic perspective view of the disassembled second lengthwise end of the development unit, showing the second bearing member and second end cover.
Figure 12:
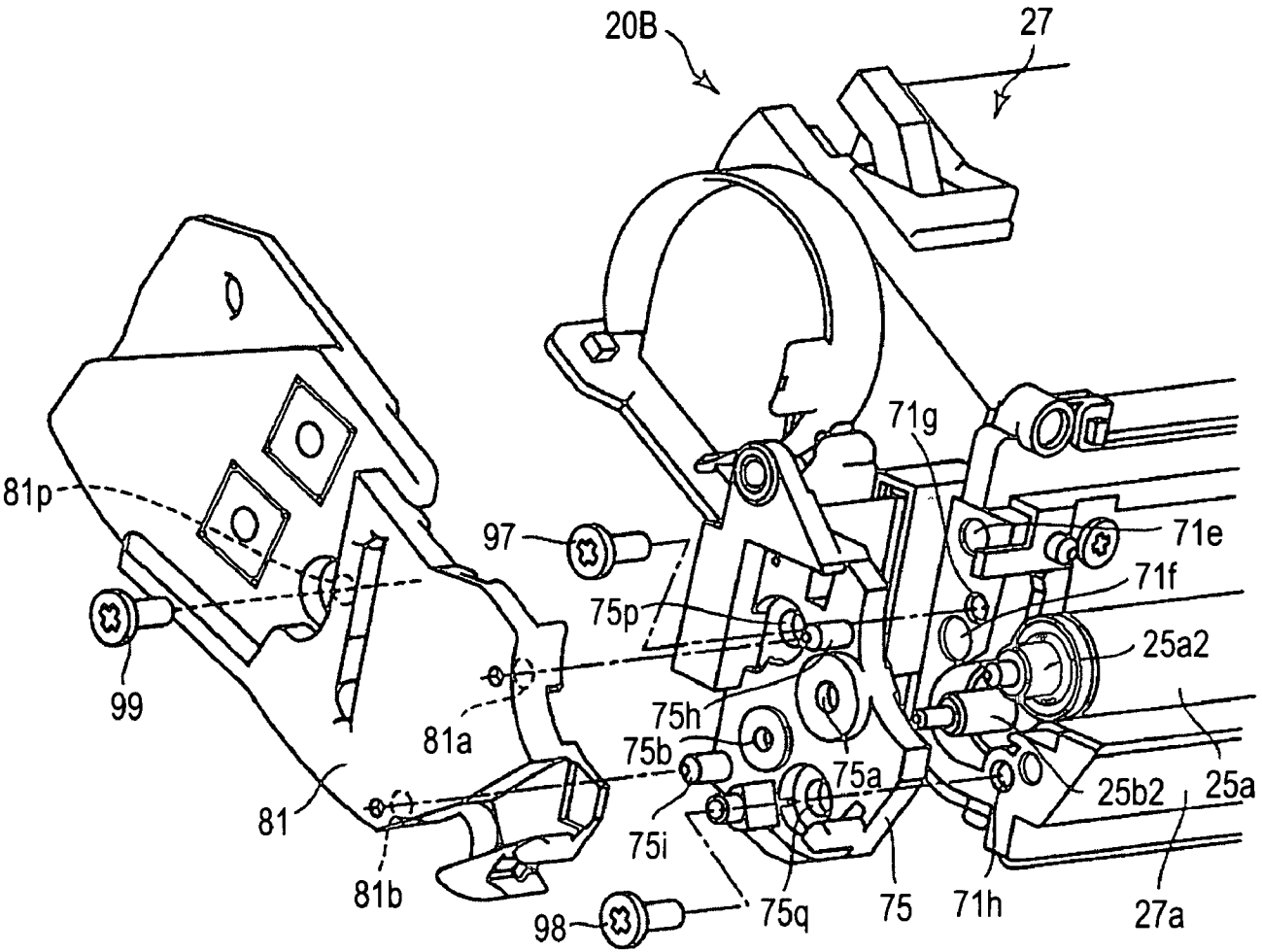
FIG. 12 is a schematic perspective view of the disassembled second lengthwise end of the development unit, showing the second bearing member and second end cover.
Figure 13:
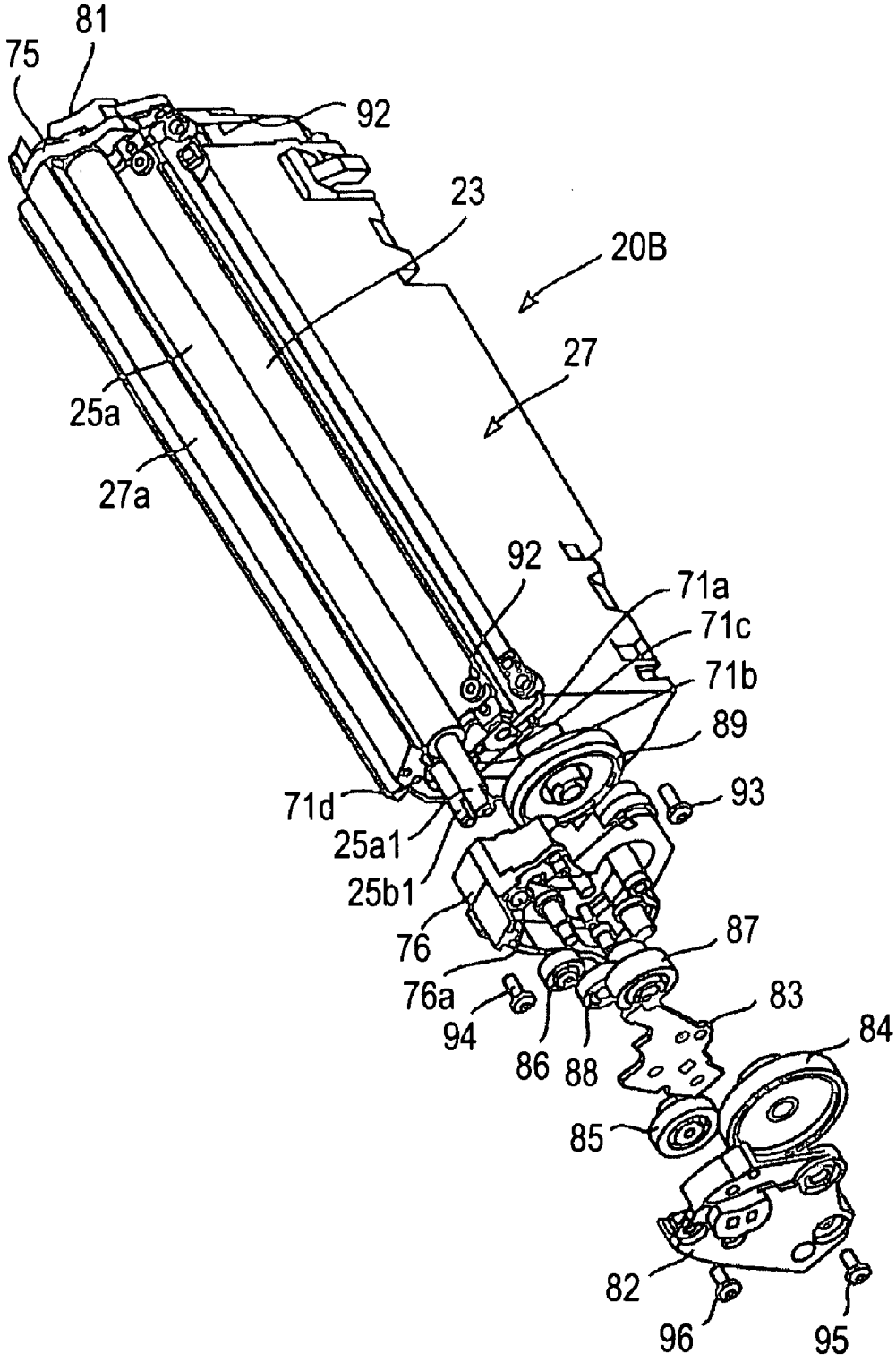
FIG. 13 is a schematic perspective view of the partially disassembled development unit, after the removal of the first bearing member therefrom.
Figure 14:
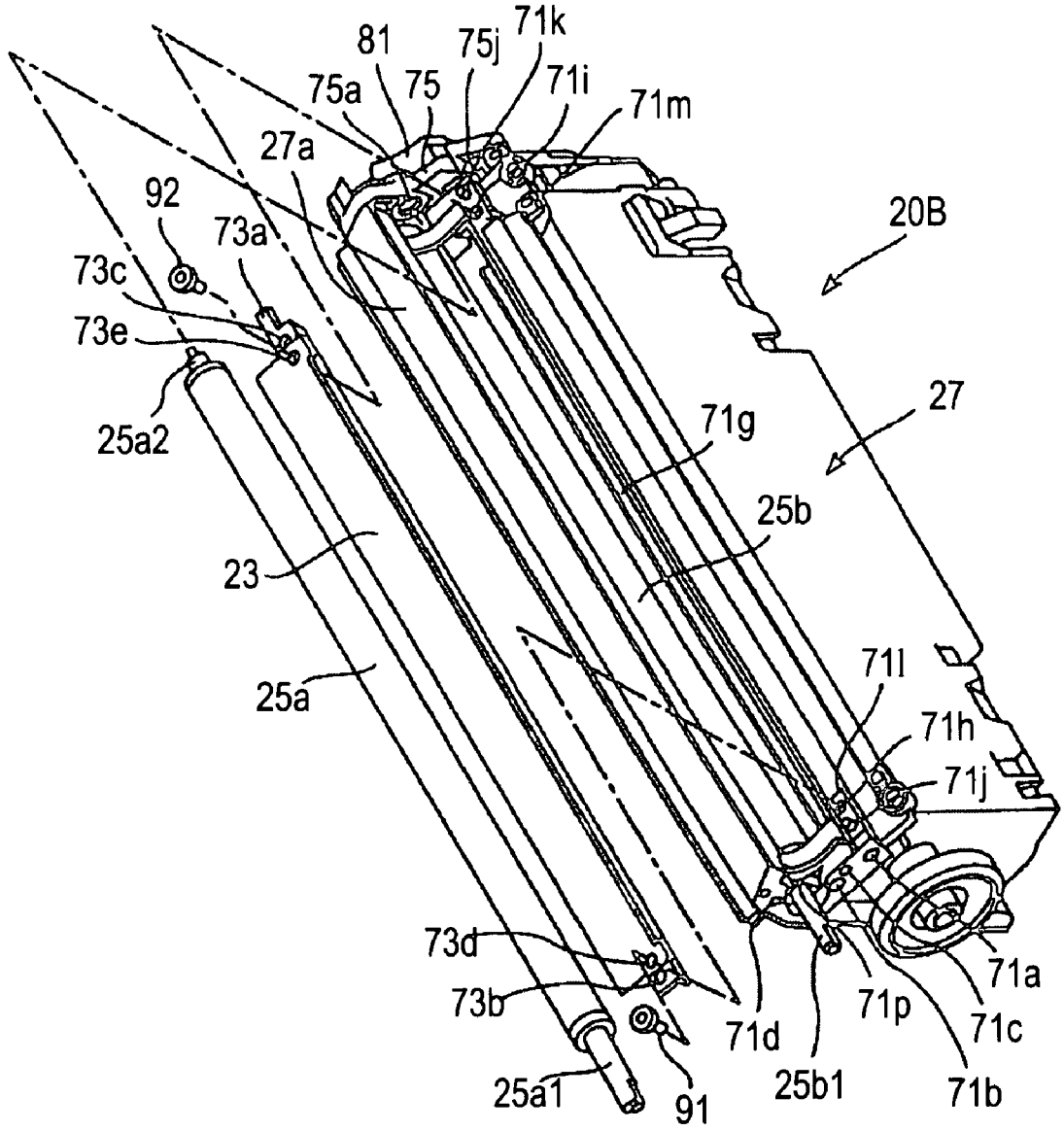
FIG. 14 is a schematic perspective view of the partially disassembled development unit, after the removal of the development roller and development blade therefrom.

FIG. 5 is a schematic side view of the development unit 20B as seen from the direction of one of the lengthwise ends of the development unit 20B, and FIG. 6 is a schematic sectional view of the lengthwise end of the development unit 20B shown in FIG. 5. FIG. 7 is a perspective view of the partially disassembled development unit 20B, showing the general structure thereof. FIGS. 8–10 are perspective views of the partially disassembled lengthwise end portion of the development unit 20B, shown in FIG. 5, different in disassembly stage and perspective. FIGS. 11 and 12 are perspective views, different in perspective, of the other lengthwise end of the development unit 20B, which also is partially disassembled. FIG. 13 is a perspective view, similar to FIG. 7, of the partially disassembled development unit 20B, showing the general structure thereof. FIG. 14 is a perspective view of the development unit 20B, the development roller 25*a* and development blade 23 which are separated from the development unit 20B.

The development unit 20B has the main frame 27 and pair of bearing members 75 and 76. The development unit frame 27 comprises the developing means container 27*a*, and the toner container 27*b* which stores toner. The bearing members 75 and 76 are located at the lengthwise ends of the developing means container 27*a*, one for one, to support the development roller 25*a* and the toner supply roller 25*b*.

Referring to FIGS. 8 and 9, the development unit 20B is provided with an end cover 82 as a first end cover, a bearing member 76 as a first bearing member, and a supporting member 83, which are attached to the same lengthwise end of the main frame 27 of the development unit 20B. Further, the development unit 20B is provided with a gear train which is for driving the development roller 25*a*, the toner supply roller 25*b*, and the toner conveying member 28 by receiving a driving force from a gear (unshown) of the apparatus main assembly, and which is attached to the same lengthwise end of the frame 27 as the aforementioned end to which the end cover 82, etc., are attached. In other words, the driving force reception gear 84 for receiving a driving force from the apparatus main assembly B, a development roller gear 85 with which one (which hereinafter will be referred to as first lengthwise end) of the lengthwise ends of the development roller 25*a* is fitted, a toner supply roller gear 86 with which the first lengthwise end of the toner supply roller 25*b* is fitted, a first driving force transmission gear 87, a second driving force transmission gear 88, and a toner conveying member gear 89 with which the first lengthwise end of the toner conveying member 28 is fitted, are located at the aforementioned first lengthwise end of the development unit 20B.

The driving force reception gear 84 comprises a first driving force receiving portion 84*a*, and a second driving force receiving portion 84*b*. The first driving force transmission gear 87 comprises a first driving force transmitting portion 87*a* and a second driving force transmitting portion 87*b*.

The bearing member 76 has holes 76*a* and 76*b*, through which the aforementioned lengthwise end portion 25*a*1 of the shaft of the development roller 25*a*, and the aforementioned lengthwise end portion 25*b*1 of the shaft of the toner supply roller 25*b*, are put to be rotatably supported by the bearing member 76 (FIG. 10). Further, the bearing member 76 has gear shafts 76*c*, 76*d*, and 76*e* around which the driving force reception gear 84, the first driving force transmission gear 87, and the second driving force transmission gear 88, are fitted to be rotatably supported. In addition, the bearing member 76 has positioning projections 76*h* and 76*i* which are fitted into the holes of a regulating member 83.

The toner conveying member gear 89 is fitted around a toner conveying member gear shaft 90 rotatably supported by the development unit main frame 27.

Referring to FIGS. 13 and 14, the development blade 23 is attached to the development blade mounts 71*l* and 71*m* located at the lengthwise ends of the developing means container 27*a*, with the use of screws 91 and 92 screwed into the screw holes 71*h* and 71*i* of the development blade mounts 71*l* and 71*m*, one for one.

Next, referring to FIGS. 5 and 6, the structure for transmitting a driving force will be described.

The driving force reception gear 84 of the development unit 20B receives the driving force from the apparatus main assembly B, and transmits the driving force to the development roller 25*a*, the toner supply roller 25*b*, and the toner conveying member 28.

The transmission of the driving force from the driving force reception gear 84 to the development roller 25*a* is accomplished by the meshing of the driving force receiving portion 84*a* of the driving force reception gear 84 with the development roller gear 85.

As for the transmission of the driving force to the toner supply roller 25*b*, the second driving receiving portion 84*b* of the driving force reception gear 84 meshes with the second driving force transmitting portion 87*b* of the first driving force transmission gear 87. The second driving force transmitting portion 87*b* of the first driving force transmission gear 87 meshes with the second driving force transmission gear 88. Further, the second driving transmission gear 88 meshes with the toner supply roller gear 86, transmitting thereby the driving force to the toner supply roller 25*b*.

As for the transmission of the driving force to the toner conveying member 28, the second driving force receiving portion 84*a* of the driving force reception gear 84 meshes with the second driving force transmitting portion 87*b* of the first driving force transmission gear 87, and the first driving force transmitting portion 87*a* of the first driving force transmission gear 87 meshes with the toner conveying member gear 89, transmitting thereby the driving force to the toner conveying member 28.

Next, referring to FIG. 8, the supporting member 83, which will also be referred to as a regulating member, will be described.

The supporting member 83 is located at the aforementioned first lengthwise end of the development unit 20B. It is positioned outward of the first driving force transmission gear 87 for transmitting the driving force to the toner supply roller 25*b*. Further, it is positioned outward of the second driving force transmission gear 88 and the toner supply roller gear 86. The regulating member 83 in this embodiment is a piece of metallic plate such as steel plate. Obviously, the regulating member 83 does not need to be made of steel plate; it may be made of resin, FRP (fiber-reinforced plastic), or the like.

The supporting member 83 is provided with positioning holes 83*a* and 83*b* into which the positioning projections 76*h* and 76*i* of the bearing member 76 are fitted, holes 83*c* and 83*d* into which the end portions 76*d*1 and 76*e*1 of the gear shafts 76*d* and 76*e* for supporting the first and second driving force transmission gears 87 and 88 are fitted, and hole 83*e* into which an elastic claw 76*k*, as the supporting member retaining member, of the bearing member 76 engages.

The supporting member 83 is precisely positioned relative to the development unit main frame 27, as the positioning projections 76*h* and 76*i* of the bearing member 76 are fitted into the positioning holes 83*a* and 83*b* of the supporting member 83. As for the holes 83*c* and 83*d* of the regulating member (supporting member) 83, the end portions 76*d*1 and 76*e*1 of the bearing member 76 fit into them, one for one, keeping thereby constant the distance between the axial lines of the gears 88 and 87.

The gear shaft 76*d* for supporting the first driving force transmission gear 87 cannot be supported by the shaft attached to the end cover 82, because of the presence of the driving force reception gear 84 between the first driving force transmission gear 87 and the end cover 82. However, the end portion of the gear shaft 76*d* is fitted in the hole of the supporting member 83, being thereby prevented from wobbling when the driving force is transmitted to the first driving force transmission gear 87. As for the gear shaft 76*e* for supporting the second driving force transmission gear 88, no gear is present between it and the end cover 82, and therefore, it is supported by the gear shaft 76*e* supported by the supporting member 83 and the end cover 82. However, the second driving force transmission gear 88 may be supported by a gear shaft attached to only one of the supporting member 83 and the end cover 82.

The elastic claw 76*k* (supporting member retaining portion) of the bearing member 76 is fitted in the hole 83*e* of the supporting member 83, making it thereby difficult for the supporting member 83 to become separated from the bearing member 76.

The supporting member 83 is sandwiched between the bearing member 76 and the end cover 82; parts (portions surrounding positioning holes) of the supporting member 83 are placed in contact with the end cover 82, keeping thereby the supporting member 83 kept pressed on the bearing member 76.

Next, referring to FIGS. 3–14, the method, in this embodiment of the present invention, for remanufacturing the process cartridge 20 will be described.

[Unit Separation Process]

The unit separation process for separating the photosensitive drum unit 20A of the cartridge 20 from the development unit 20B of the cartridge 20 is as follows.

Referring to FIG. 4, the pair of pins 29 are located at the lengthwise ends of the cartridge 20, one for one, being inserted in the hole 77 of the bearing member 75 located at the second lengthwise end of the cartridge 20, and the hole 77 of the bearing member 76 located at the first lengthwise end, to connect the photosensitive drum unit 20A and development unit 20B so that they are rotatable about the pair of pins 29.

The pins 29 are a metallic pins comprising two portions different in diameter. First, the pins 29 are to be pulled out of the holes 77 of the bearing members 75 and 76 to enable the two units 20A and 20B to be separated from each other. Should the pins 29 be damaged by the tools while being pulled out of the holes, they may be replaced with new ones during the reassembly.

[Method for Disassembling Development Unit]

Next, the method for disassembling the development unit B will be described step by step.

First, referring to FIG. 9, the process for removing the end cover 82 (first end cover) will be described. This process is the process for removing the screws 95 and 96, and removing the end cover 82 attached to the aforementioned first lengthwise end of the separated development unit 20B.

To describe in more detail, the end cover 82 is attached to the bearing member 76 located at the aforementioned first lengthwise end of the development unit 20B, with the use of the screws 95 and 96, as shown in FIGS. 4 and 9. Thus, the end cover 82 can be removed from the bearing member 76 by removing these screws 95 and 96.

Next, referring to FIG. 9, the process for removing the first group of gears will be described. This process is for removing the first group of gears (driving force reception gear 84 and development roller gear 85) from the bearing member 76 attached to the first lengthwise end of the development unit main frame 27.

To describe in more detail, as the end cover 82 is removed, the first group of gears comprising the driving force reception gear 84 and the development roller gear 85 located at the aforementioned first lengthwise end of the development unit 20B is exposed. Then, the driving force reception gear 84 and development roller gear 85 are pulled away from the gear shaft 76*c* of the bearing member 76, and the end portion 25*a*1 of the shaft of the development roller 25*a*, respectively. In other words, this step makes it easier to remove the first group of gears from the bearing member 76.

Next, referring to FIG. 8, the process for removing the supporting member 83 will be described. This process is for removing the supporting member 83 from the bearing member 76 after the removal of the first group of gears.

To describe in more detail, in the hole 83*e* of the supporting member 83, the aforementioned claw 76*k* of the bearing member 76 is locked, firmly holding the supporting member 83 to the bearing member 76. Thus, the supporting member 83 can be removed from the bearing member 76 by elastically bending the claw 76*k* within its range of elastic deformation.

Next, referring to FIG. 8, the process for removing the second group of gears will be described. This process is for removing the second group of gears (toner supply roller gear 86, first driving force transmission gear 87, and second driving force transmission gear 88) located on the inward side of the supporting member 83, from the bearing member 76.

To describe in more detail, first, the supporting member 83 is removed from the bearing member 76, exposing thereby the toner supply roller gear 86, the first driving force transmission gear 87, and the second driving force transmission gear 88, which are located inward of the supporting member 83 and make up the second group of gears. This removal of the supporting member 83 makes it easy to pull the gears 86, 87, and 88 of the second group of gears away from the end portion 25*b*1 of the shaft of the toner supply roller 25*b*, the gear shaft 76*d* of the bearing member 76, and the gear shaft 86*e* of the bearing member 76, respectively.

Next, referring to FIGS. 10 and 13, the process for removing the bearing member (first bearing member) will be described. This process is for removing the bearing member 76 attached to the development unit main frame 27, from the development unit main frame 27.

To describe in more detail, the bearing member 76 is attached to the aforementioned first lengthwise end of the developing means container 27*a* with the use of the screws 93 and 94. Further, the bearing member 76 rotatably supports the development roller 25*a* and toner supply roller 25*b*, with the shaft of the development roller 25*a* and toner supply roller 25*b* put through the holes 76*a* and 76*b* of the bearing member 76, respectively. Thus, the bearing member 76 can be removed from the developing means container 27*a* by pulling the bearing member 76 in the lengthwise direction of the development unit 20B after the removal of the screws 93 and 94.

Next, referring to FIG. 14, the process for removing the development roller 25*a* will be described. This process is for removing the development roller 25*a* from the development unit main frame 27.

Figure 16:
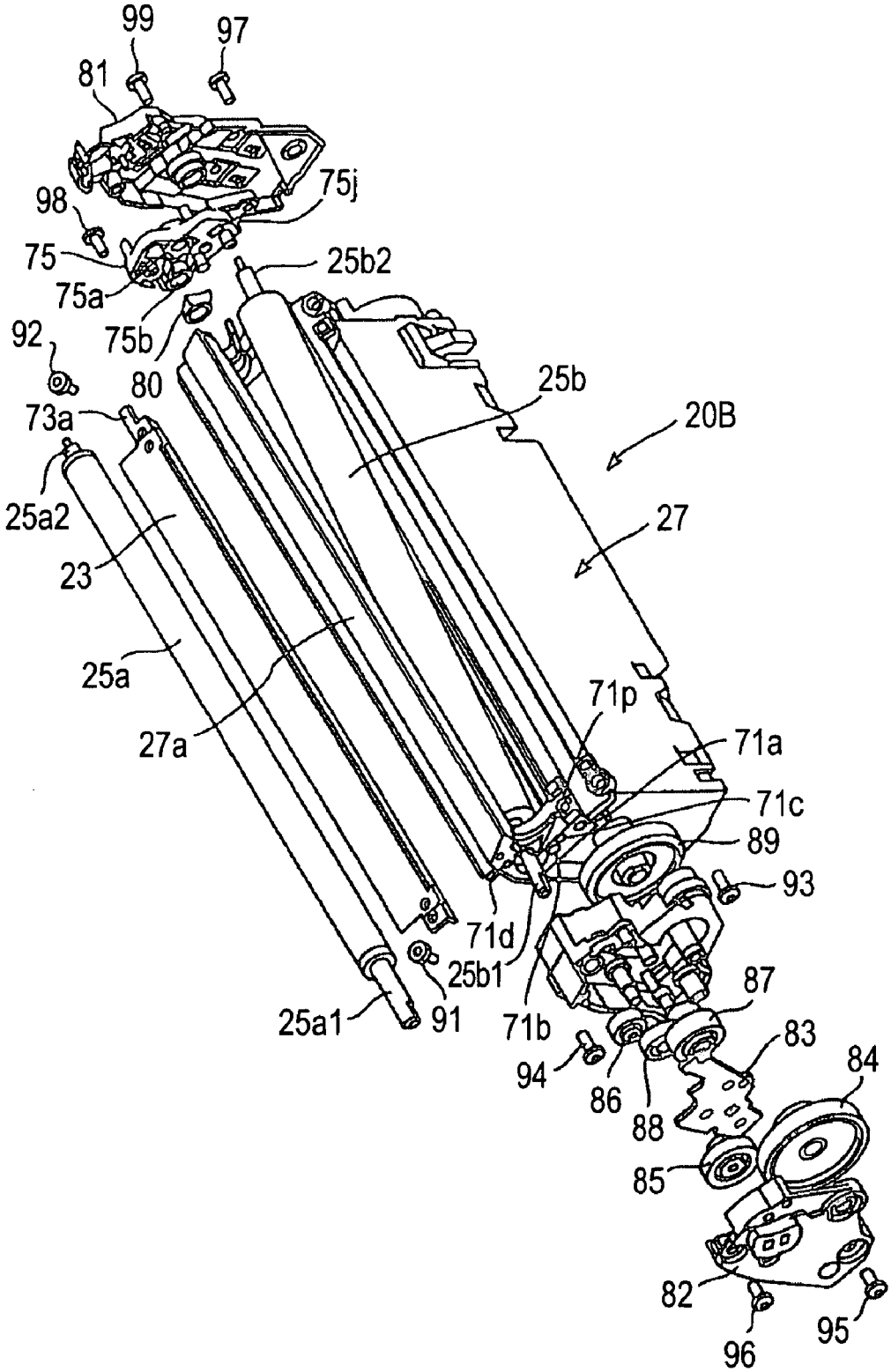
FIG. 16 is a perspective view of the partially disassembled development unit, the second lengthwise end of the toner supply roller of which has been lifted.

To describe in more detail, as will be evident from FIG. 16, at the opposite end (second lengthwise end) of the development unit 20B from the aforementioned first lengthwise end, the end portion 25*a*2 of the shaft of the development roller 25*a* is fitted in the hole 75*a* of the bearing member 75. Therefore, the development roller 25*a* can be removed from the development unit main frame 27 by pulling the development roller 25*a* toward the aforementioned first lengthwise end of the development unit 20B.

Next, referring to FIG. 14, the process for removing the development blade 23 will be described. This process is for removing from the development unit main frame 27 the development blade 23 for regulating the amount by which the developer (toner) is allowed to remain adhered to the peripheral surface of the development roller 25*a*.

To describe in more detail, the development blade 23 is attached to the development blade mounts 71*j* and 71*k* of the developing means container 27*a* with the use of the screws 91 and 92 as described above. Further, the development unit 20B is provided with an electrical contact 73*a* which is for high voltage application, and which projects outward through the through hole 75*j* of the bearing member 75 located at the second lengthwise end of the development unit 20B.

Thus, first, the screws 91 and 92 are removed. Then, the aforementioned first lengthwise end side of the development blade 23 is to be lifted so that the development blade positioning projections 71*l* and 71*m* of the developing means container 27*a* come out of the positioning holes 73*b* and 73*c* of the development blade 23. Then, the development blade 23 is moved toward the first lengthwise end to pull the electrical contact 73*a* out of the through hole 75*j* of the bearing member 75 located at the second lengthwise end of the development unit 20B. Then, the development blade 23 can be removed from the developing means container 27*a*.

With the step-by-step completion of the above described processes, the process for disassembling the development unit 20B is completed. As a result, the developer delivery hole 71*g* of the development unit 20B is exposed, making it possible to refill the toner container 27*b* with toner. The development unit 20B has the supporting member 83, as described above. Thus, while the supporting member 83 remains attached to the development unit 20B, it does not occur that the second group of gears accidentally falls off. In other words, the presence of the supporting member 83 affords more latitude in terms of the attitude of the development unit 20B during development unit disassembly, making it easier to assemble or disassemble the development unit 20B.

[Toner Refilling Process]

Next, referring to FIG. 15, the process for refilling the cartridge 20 with toner will be described. This process is for filling the developer storage portion (toner container 27*b*) with developer (toner) through the developer delivery hole 71*g* exposed by the removal of the development blade 23.

Figure 15:
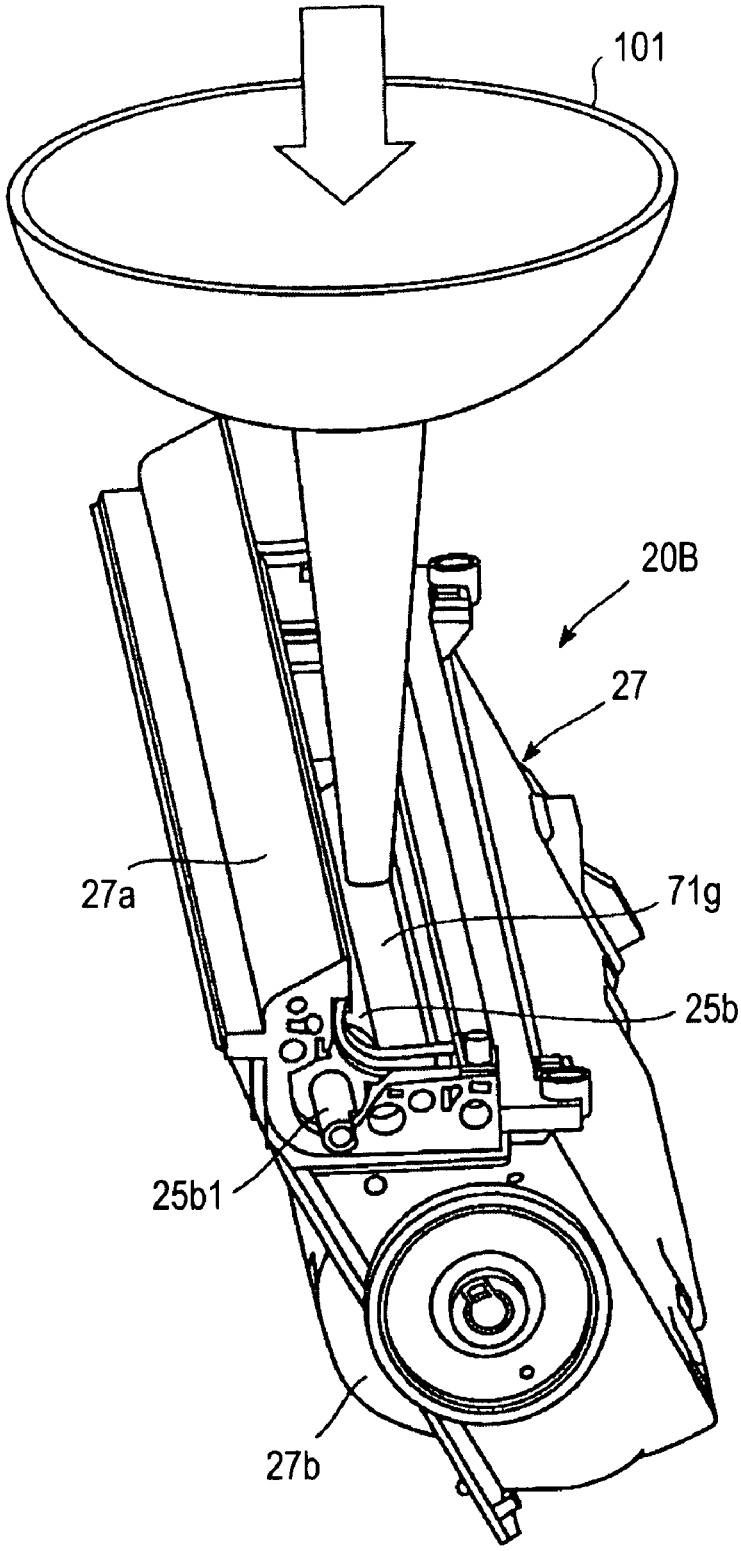
FIG. 15 is a schematic perspective view of the development unit, from which the toner supply roller has not been removed, and which is fitted with the funnel, depicting the process for refilling the development unit with developer (toner) according to the present invention.

To describe in more detail, referring to FIG. 15, first, the development unit 20B is held in such an orientation that the developer delivery hole 71*g* faces upward, and that the toner container 27*b* is located at the bottom. Then, the tip of a funnel 101 is inserted into the toner container 27*b* through the developer delivery hole 71*g*. Then, the toner is poured into the funnel 101 from a toner bottle (unshown) or the like. As a result, the toner container 27*b* is refilled with the developer (toner). Incidentally, the employment of a developer supplying apparatus comprising a funnel, and a metering device placed in the funnel, can improve the efficiency with which the toner container 27*b* is refilled with toner.

[Method for Assembling Development Unit]

After the completion of the above described refilling of the toner container 27*b* with toner, the cartridge 20 is reassembled. All that is necessary to reassemble the cartridge 20 is to carry out the above described disassembly processes in the reverse order. Next, the processes for reassembling the development unit 20B will be described in the order in which they are to be carried out.

First, referring to FIG. 14, the process for attaching the development blade 23 will be described. This process is for attaching the development blade 23 to the development unit main frame 27.

To describe in more detail, the development blade 23 is to be brought to the development unit 20B at a slight angle from the first lengthwise end of the development unit 20B, so that the electrical contact 73*a* enters the through hole 75*j* (FIG. 16) of the bearing member 75. Then, the blade 23 is placed against the development unit main frame 27 so that the development blade positioning projections 71*j* and 71*k* fit into the positioning holes 73*b* and 73*c* in the lengthwise end portions of the development blade 23, one for one. This accurately positions the development blade 23 relative to the development unit main frame 27. Then, the screws 91 and 92 are put through the through holes 73*d* and 73*c* of the development blade 23. Next, the screws 91 and 92 put through the through holes 73*d* and 73*c* of the development blade 23 are screwed into the development blade attachment screw holes 71*h* and 71*i* of the blade mounts 71*l* and 71*m* of the developing means container 27*a*. Incidentally, the projections 71*j* and 71*k* project from the development blade mount 71*l* and 71*m* of the developing means container 27*a*.

Next, referring to FIGS. 10–14, and 16, the process for attaching the development roller 25*a* will be described. In this process, the end portion 25*a*2 of the shaft of the development roller 25*a* located at the second lengthwise end of the development unit 20B is fitted into the hole 75*a* of the bearing member 75 attached to the development unit main frame 27. Further, the end portion 25*a*1, that is, the first lengthwise end portion, of the shaft of the development roller 25*a* is fitted into the hole 76*a* of the bearing member 76. This attaches the development roller 25*a* to the development unit main frame 27.

To describe in more detail, the development roller 25*a* is inserted into the developing means container 27*a* from the first lengthwise end so that the end portion 25*a*2 of the shaft of the development roller 25*a*, on the second lengthwise end side of the development unit 20B, is inserted into the hole 75*a* of the bearing member 75. This process places the development roller 25*a* in the developing means container 27*a*, so that the development roller 25*a* is borne by the bearing member 75 attached to the development unit main frame 27.

The developing means container 27*a*, which belongs to the development unit main frame 27, is provided with positioning holes 71*a* and 71*b*, and small screw holes 71*c* and 71*d*, which are located at the first lengthwise end of the development unit 20B. The bearing member 76 is provided with positioning projections 76*m* and 76*n*, which fit into the positioning holes 76*a* and 76*b* located in the first lengthwise end portion of the developing means container 27*a*. The first lengthwise end portion of the shaft of the development roller 25*a* and the first lengthwise end portion of the shaft of the toner supply roller 25*b* are put through the holes 76*a* and 76*b* of the bearing member 76 so that they are rotatably supported by the bearing member 76.

Next, the positioning projections 76*m* and 76*n* of the bearing member 76 are fitted into the holes 71*a* and 71*b* of the first lengthwise end portion of the developing means container 27*a*. As a result, the bearing member 76 is accurately positioned relative to the developing means container 27*a*. Then, the screws 93 and 94 are screwed into the screw holes of the developing means container 27*a* to solidly fix the bearing member 76 to the developing means container 27*a*. The screws 93 and 94 are put through the screw holes 76*p* and 76*q* (through holes) of the bearing member 76, and anchored into the screw holes 71*c* and 71*d* of the developing means container 27*a*. As a result, the bearing member 76 is solidly attached to the developing means container 27*a*. The development roller 25*a* is attached to the development unit main frame 27.

Next, referring to FIGS. 8 and 9, the process for attaching the second group of gears will be described. This process is for attaching the second group of gears (toner supply roller gear 86, first driving force transmission gear 87, and second driving force transmission gear 88, and regulating member 83) to the bearing member 76 attached to the first lengthwise end of the development unit main frame 27.

The toner supply roller gear 86 is fitted around the first lengthwise end portion 25*b*1 of the shaft of the toner supply roller 25*b*. The first driving force transmission gear 87 is fitted around the gear shaft 76*d* of the bearing member 76, being thereby rotatably supported by the gear shaft 76*d*. The driving force transmitting portion 87*a* of the first driving force transmission gear 87 meshes with the toner conveying member gear 89. The second driving force transmission gear 88 is fitted around the gear shaft 76*e* of the bearing member 76, being thereby rotatably supported by the gear shaft 76*e*. The second driving force transmission gear 88 meshes with the second driving force transmitting portion 87*b* of the first driving force transmission gear 87, and the toner supply roller gear 86.

Next, referring to FIG. 8, the process for attaching the supporting member 83 will be described. This process is for attaching the supporting member 83 to the bearing member 76, to which the second group of gears has just been attached, in such a manner that the supporting member 83 overlaps with at least a part of the second group of gears, and also, that the supporting member 83 is positioned outward of the second group of gears in terms of the lengthwise direction of the development unit main frame 27.

The supporting member 83 is accurately positioned relative to the bearing member 76 because the positioning projections 76*h* and 76*i* of the bearing member 76 fit into the positioning holes 83*a* and 83*b*, respectively, of the supporting member 83. Further, the end portions 76*d*1 of the gear shaft 76*d* of the bearing member 76, and the end portion 76*e*1 of the gear shaft 76*e* of the bearing member 76, are fitted into the holes 83*c* and 83*d*, respectively, of the supporting member 83. Therefore, the gear shafts 76*d* and 76*e* of the bearing member 76 are prevented by the supporting member 83 from wobbling as the driving force is transmitted.

The first driving force transmission gear 87, the second driving force transmission gear 88, and the toner supply roller gear 86 are at least partially covered with the supporting member 83. Further, as the supporting member 83 is pushed toward the bearing member 76, with the gear shafts 76*d* and 76*e* of the bearing member 76 fitted in the holes 83*c* and 83*d*, the claw 76*k* of the bearing member 76 is elastically bent, and then, snaps into the hole 83*e* of the supporting member 83, making it unlikely for the supporting member 83 to become disengaged from the bearing member 76. Therefore, it is unlikely for the first driving force transmission gear 87, the second driving force transmission gear 88, and the toner supply roller gear 86 to become disengaged from the bearing member 76.

Next, referring to FIG. 9, the process for attaching the first group of gears will be described. This process is for attaching the first group of gears (development roller gear 85 and driving force reception gear 84) to the bearing member 76, to which the supporting member has just been attached, in such a manner that the first group of gears is positioned outward of the supporting member 83 in terms of the lengthwise direction of development unit main frame 27.

To describe in more detail, the development roller gear 85 is fitted around the first lengthwise end portion 25*a*1 of the shaft of the development roller 25*a*. The driving force reception gear 84 is fitted around the gear shaft 76*c* of the bearing member 76, being thereby rotatably supported by the gear shaft 76*c*. The development roller gear 85 meshes with the first driving force receiving portion 84*a* of the driving force reception gear 84, and the second driving force receiving portion 84*b* of the driving force reception gear 84 meshes with the second driving force transmitting portion 87*b* of the first driving force transmission gear 87.

Next, referring to FIG. 9, the process for attaching the end cover 82 (first end cover) will be described. This process is for attaching the end cover 82 to the bearing member 76, with the interposition of the supporting member 83 so that a part of the end cover 83 is placed in contact with the supporting member 83 in a manner to keep the supporting member 83 (regulating member) pressed on the bearing member 76. The end cover 82 engages with the positioning projections 76*h* and 76*i* of the bearing member 76, being thereby accurately positioned relative to the bearing member 76.

To describe in more detail, the end cover 82 is brought to the bearing member 76 so that the positioning projections 76*h* and 76*i* of the bearing member 76 fit into the positioning holes 82*a* and 82*b* of the end cover 82. Then, after the accurate positioning of the end cover 82 relative to the bearing member 76, the end cover 82 is screwed to the bearing member 76 with the use of the screws 95 and 96, which are put through the screw holes 82*c* and 82*d* (through holes) of the end cover 82, and screwed into the screw holes 76*r* and 76*s* of the bearing member 76. As a result, the end cover 82 is solidly and accurately fixed to the bearing member 76.

The process for assembling the development unit 20B is completed by the completion of the above described process for the attachment of the end cover 82. Since the development unit 20B is provided with the supporting member 83, the second group of gears does not accidentally fall off once the supporting member 83 is attached. In other words, the provision of the supporting member 83 affords more latitude in terms of the attitude of the development unit 20B during the assembly of the development unit 20B, making it easier to assemble the development unit 20B.

[Process for Connecting Units]

Next, referring to FIG. 4, the process for connecting the photosensitive drum unit 20A to the completed development unit 20B will be described. This process is for connecting the photosensitive drum unit 20A to the development unit 20B so that they can be rotated about the axial lines of the pair of pins which connect the two units.

The photosensitive drum unit 20A and development unit 20B which are to be connected to each other are the photosensitive drum unit 20A and development unit 20B which were connected to each other before the disassembly of the cartridge 20. However, it is not mandatory that a given photosensitive drum unit 20A is joined with the development unit 20B which was connected to the given photosensitive drum unit 20A prior to the disassembly of the cartridge 20.

To describe in more detail, the drum unit 20A and the development unit 20B are positioned relative to each other so that the holes 77 in the lengthwise end portions of the drum unit 20A align with the hole 77 of the bearing member 76 and the hole 77 of the bearing member 75. Then, the pair of pins 29 are inserted into the aligned holes 77, one for one, at each lengthwise end of the cartridge 20, from outward, in the lengthwise direction, of the cartridge 20. As a result, the drum unit 20A and development unit 20B are connected to each other so that they are rotatable about the axial lines of the pair of pins 29.

This process concludes the process for assembling the cartridge 20, yielding the cartridge 20 shown in FIG. 3.

The above described method for remanufacturing the cartridge 20 makes it easier to remanufacture the cartridge 20.

Next, the other embodiments of the present invention will be described.

When a given member in the following embodiments of the present invention is identical in shape, structure, etc., as the one in the above described embodiment, it is identical to the one in the preceding embodiment, unless specifically noted.

In the above described embodiment of the present invention, the development roller 25*a* and development blade 23 are removed from the development unit 20B, or reattached thereto, without removing the end cover 81 and bearing member 75 from the development unit 20B. However, the end cover 81 and bearing member 75 may be removed before the process for disassembling the development roller 25*a*.

Next, the processes for removing the end cover 81 and bearing member 75 located at the second lengthwise end of the cartridge 20, which are carried out before the refilling of the toner container 27*b* with toner, will be described.

First, referring to FIGS. 11 and 12, the process for removing the end cover 81 (second end cover) located at the second lengthwise end of the cartridge 20 will be described. This process is for removing the screw 99, and then, removing the second end cover 81 attached to the second lengthwise end of the separated development unit 20B.

To describe in more detail, at the second lengthwise end of the development unit 20B, the end cover 81 is attached to the toner container 27*b* of the development unit 20B with the use of the screw 99. Thus, the end cover 81 can be easily removed from the development unit 20B by removing this screw 99.

Next, referring to FIGS. 7, 11, and 12, the process for removing the bearing member 75 (second bearing member) will be similarly described. This process is for removing the bearing member 75 attached to the second lengthwise end of the development unit main frame 27, from the development unit main frame 27.

The bearing member 75 is attached to the second lengthwise end of the developing means container 27*a* with the use of the screws 97 and 98. Further, the development roller 25*a* and toner supply roller 25*b* are rotatably supported by the bearing member 75; the shaft of the development roller 25*a* and the shaft of the development supply roller 25*b* are fitted in the holes 75*a* and 75*b* of the bearing member 75. Therefore, the bearing member 75 can be easily removed from the developing means container 27*a* by pulling the bearing member 75 outward of the developing means container 27*a* in the lengthwise direction of the development unit 20B after the removal of the screws 97 and 98.

Next, the processes for attaching the bearing member 75 and second end cover 81 to the second lengthwise end of the development unit main frame 27, which are to be carried out after the refilling of the toner container 27*b* with toner, will be described. Here, the case in which after the refilling of the toner container 27*b* with toner, the processes for attaching the development blade 23 and the process for development roller 25*a* are carried out first, and then, the processes for attaching the second bearing member 75 and second end cover 81 are carried out, will be described.

First, referring to FIGS. 7, 11, and 12, the process for attaching the second bearing member 75 will be described. This process is for fitting the second end portion 25*a*2 of the shaft of the development roller 25*a* into the hole 75*a* of the second bearing member 75, and attaching the bearing member 75 to the development unit main frame 27.

The second lengthwise end portion of the developing means container 27*a* of the development unit main frame 27 is provided with the positioning holes 71*e* and 71*f*, and the screw holes 71*g* and 71*h*. Further, the bearing member 75 is provided with the positioning projections 75*m* and 75*n* which are to be fitted into the positioning holes 71*e* and 71*f* of the developing means container 27*a*.

The second end portion 25*a*2 of the shaft of the development roller 25*a*, and the second end portion 25*b*2 of the shaft of the toner supply roller 25*b*, are put through the holes 75*a* and 75*b* of the bearing member 75, being thereby rotatably supported by the bearing member 75.

Next, the positioning projections 75*m* and 75*n* of the bearing member 75 are fitted into the positioning holes 71*e* and 72*f* of the second lengthwise end portion of the developing means container 27*a*, so that the bearing member 75 is accurately positioned relative to the developing means container 27*a*. Then, the bearing member 75 is solidly fixed to the developing means container 27*a* with the use of the screws 97 and 98. The screws 97 and 98 are put through the through holes 75*p* and 75*q* of the bearing member 75, and screwed into the screw holes 71*g* and 71*h* of the developing means container 27*a*, solidly fixing the bearing member 75 to the developing means container 27*a*.

Next, referring to FIGS. 7, 11, and 12, the process for attaching the second end cover 81 will be described. This process is for attaching the second end cover 81 to the second bearing member 75.

To describe in more detail, the second end cover 81 is accurately positioned relative to the bearing member 75, as the positioning projections 75*h* and 75*i* of the bearing member 75 are fitted into the positioning holes 81*a* and 81*b* of the second end cover 81. Then, the end cover 81 is screwed to the development unit main frame 27 with the use of the screw 99. The screw 99 is put through the screw hole 81*c* (through hole) of the end cover 81, and screwed into the screw hole of the development unit main frame 27, solidly fixing the end cover 81 to the development unit main frame 27.

The above described process for removing the second end cover 81, and process for removing the second bearing member 75 have only to be carried out between the separation of the development unit 20B and the refilling of the developing means container 27*a* with developer (toner); it may be carried out any time as long as it is after the separation of the development unit 20B and prior to the refilling of the developing means container 27*a* with developer (toner). For example, as long as they are carried out before the removal of the development roller 25*a*, the process for removing the development roller 25*a*, and the process carried out after the removal of the development roller 25*a* to remove the development blade 23, become easier, simplifying thereby the method for remanufacturing the process cartridge.

The above described process for attaching the second bearing member, and process for attaching the second end cover may be carried out any time as long as it is after the refilling of the developing means container 27*a* with developer (toner) and before the process for attaching the photosensitive drum unit and development unit to each other.

Next, another embodiment of the present invention will be described.

In the above described embodiments, the process for refilling the toner container 27*b* with developer (toner) is carried out without removing the toner supply roller 25*b* from the development unit 20B. However, the toner supply roller 25*b* may be removed prior to the process for refilling the toner container 27*b* with developer (toner); it is to be reattached after the process for refilling the toner container 27*b* with developer (toner).

Next, the process carried out, before the process for refilling the toner container 27*b* with developer (toner), to remove the toner supply roller 25*b*, will be described. In this embodiment, the process for removing or attaching the toner supply roller 25*b* after the completion of the process, in the preceding embodiment, for removing the development blade and second bearing member, will be described.

First, referring to FIGS. 16 and 17, the process for removing the toner supply roller 25*b* will be described. This process is for removing the development supply roller (toner supply roller 25*b*) for supplying the development roller 25*a* with developer (toner) from the development unit main frame 27, prior to the refilling of the toner container 27*b* with developer (toner).

To the lengthwise ends of the developing means container 27*a*, a pair of end seals 100 for preventing the toner from leaking from the lengthwise ends of the development roller 25*a* are pasted with the use of two-sided adhesive tape.

Thus, first, the end seal 100 located at the second lengthwise end of the developing means container 27*a* is to be partially peeled, and the peeled portion is left turned over, exposing the end seal mount. Then, a bushing 80 which is loosely fitted around the second end portion 25*b*2 of the shaft of the development supply roller 25*b*, and with which the developing means container 27*a* is fitted, is removed by being pulled outward of the developing means container 27*a* in the lengthwise direction of the development unit main frame 27. The bushing 80 is formed of an elastic substance such as rubber, and its elasticity is utilized to elastically compress the bushing 80 into the developing means container 27*a*.

The removal of the bushing 80 from the developing means container 27*a* makes it possible to lift the second lengthwise end portion of toner supply roller 25*b*. Then, the toner supply roller 25*b* is moved in the direction indicated by an arrow mark while being tilted relative to the developing means container 27*a*, as shown in FIG. 17, in order to pull out the first end portion 25*b*1 of the shaft of the toner supply roller 25*b* located at the first lengthwise end of the developing means container 27*a*, from the through hole 71*p*, in which the first end portion 25*b*1 of the shaft of the toner supply roller 25*b* is loosely fitted. As a result, the toner supply roller 25*b* is removed from the development unit 20B, exposing thereby the developer delivery hole 71*g*, and therefore, making it possible to carry out the process for refilling the toner container 27*b* with toner.

Next, referring to FIGS. 16 and 17, the process for attaching the toner supply roller 25*b* after the process for refilling the toner container 27*b* with toner will be described.

Figure 17:
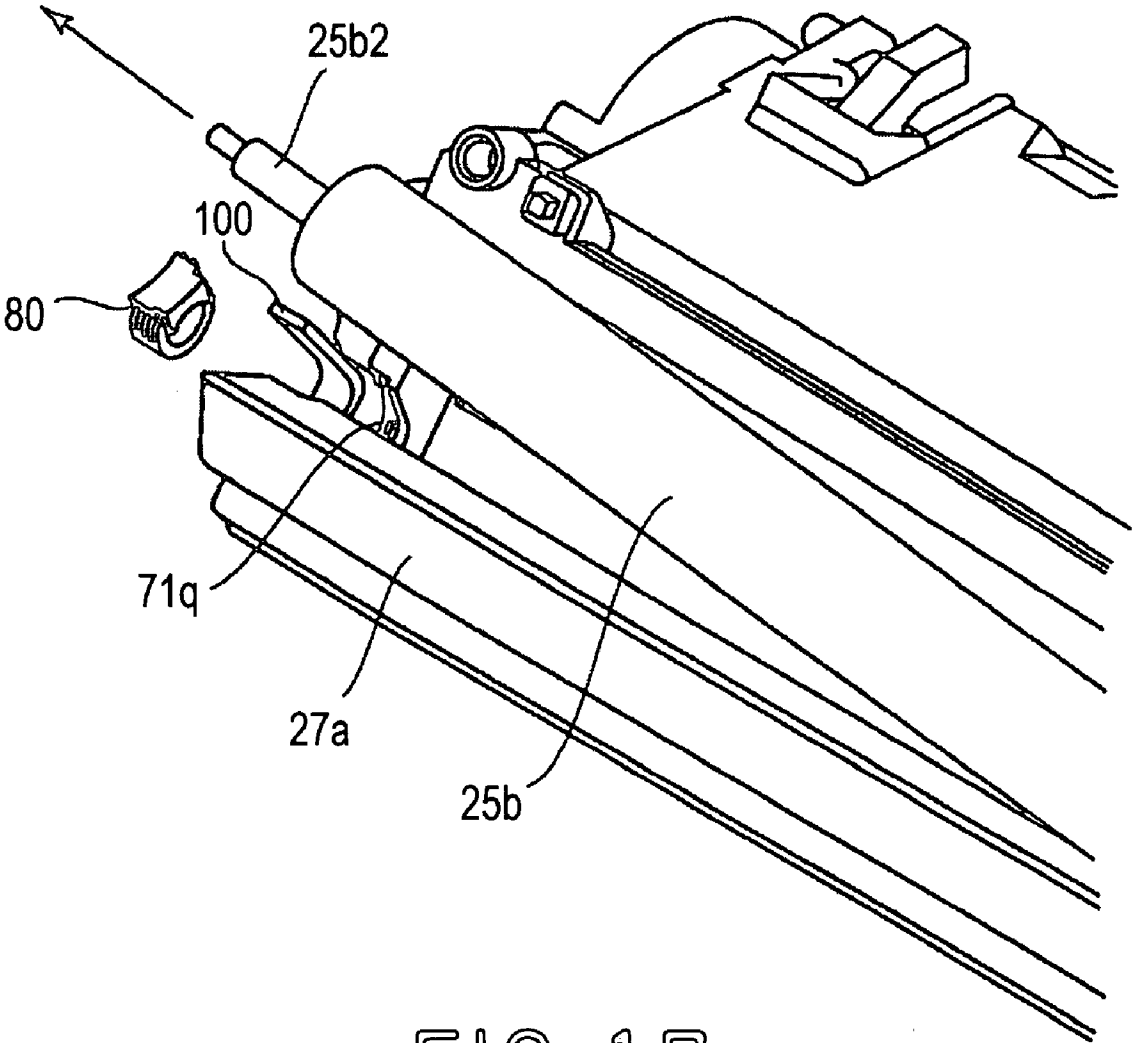
FIG. 17 is a perspective view of the second lengthwise end of the development unit, the second lengthwise end of the toner supply roller of which has been lifted.
Figure 18:
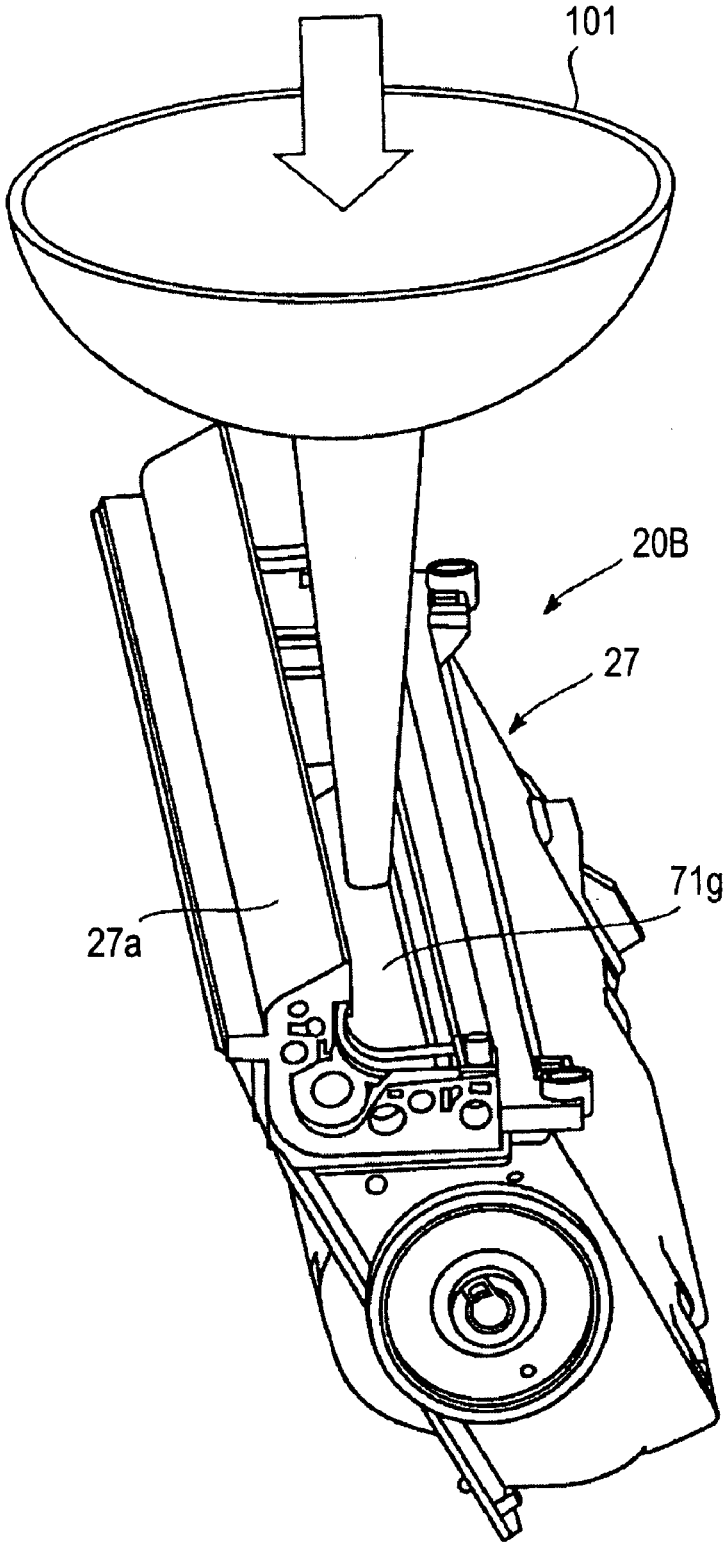
FIG. 18 is a schematic perspective view of the partially disassembled development unit, from which the toner supply roller has been removed, and which is fitted with the funnel, depicting the process for refilling the development unit with developer (toner).

First, referring to FIG. 17, the toner supply roller 25*b* is to be moved in the direction opposite to the direction indicated by the arrow mark in the drawing. This action makes the first end portion 25*b*1 of the shaft of the toner supply roller 25*b* to be put through the through hole 71*p* of the developing means container 27*a*. The second end portion 25*b*2 of the shaft of the development supply roller 25*b* is fitted into the bushing attachment groove 71*q* of the developing means container 27*a*. Then, the bushing 80 is compressed into the bushing attachment groove 71*q* from the second lengthwise end of the developing means container 27*a*, with the first end portion 25*b*1 of the shaft of the toner supply roller 25*b* aligned with the through hole 71P, fitting thereby the developing means container 27*a* with the bushing 80. Thereafter, the second end seal 100 is pasted back onto the end seal mount, ending thereby the process for attaching the toner supply roller 25*b*.

The process for disassembling the development unit 20B is completed by the above described removal of the toner supply roller 25*b*, exposing thereby the developer delivery hole 71*g* of the development unit 20B. As a result, it becomes possible to refill the toner container 27*b* with toner.

Further, the removal of the toner supply roller 25*b* more widely exposes the developer delivery hole 71*g* of the development unit 20B, making it easier to insert the funnel 101 into the developer delivery hole 71*g* when refilling the toner container 27*b* with toner. Further, the toner supply roller 25*b* is not damaged during the refilling of the toner container 27*b* with toner.

Up to this point, the process for removing or attaching the toner supply roller 25*b* has been described, and during the removal of the toner supply roller 25*b*, the end seal 100 has been partially peeled and the peeled portion of the end seal 100 has been kept turned over. However, the end seal 100 may be completely peeled away, and set aside so that it can be repasted during the reassembly. Obviously, an end seal having been removed from the other development unit 20B, as well as a brand-new end seal, may be used for the reassembly.

The following is the summary of the above described embodiments of the present invention.

A process cartridge remanufacturing method, in accordance with the present invention, is for remanufacturing the process cartridge which is removably mountable in the main assembly A of an electrophotographic image forming apparatus. The apparatus comprises: the photosensitive drum unit 20A for supporting the electrophotographic photosensitive drum 21; and the development unit 20B which supports the development roller 25*a* for developing an electrostatic latent image formed on the electrophotographic photosensitive drum 21, has the developer storage portion (toner container 27*b*) for storing the developer used, along with the development roller 25*a*, for developing the electrostatic latent image, and the developer delivery hole 71*g* for supplying the development roller 25*a* with the developer stored in the developer storage portion (toner container 27*b*), and connected to the photosensitive drum unit 20A so that the photosensitive drum unit 20A and development unit 20B are rotatable about the axial lines of the members connecting the two units 20A and 20B. The method comprises:

(a) the unit separation process for separating the photosensitive drum unit 20A and development unit 20B from each other;

(b) the first end cover removal process for removing the screws 95 and 96, and then, removing the first end cover 81 attached to the first lengthwise end of the separated development unit 20B;

(c) the first gear group removal process for removing the first group of gears (driving force reception gear 84, and development roller gear 85) attached to the first bearing member 76 attached to the first lengthwise end of the development unit main frame 27;

(d) the regulating or supporting member removal process for removing the supporting member 83 from the first bearing member 76, after the removal of the first group of gears (driving force reception gear 84 and development roller gear 85);

(e) the second gear group removal process for removing the second group of gears (toner supply roller gear 86, first driving force transmission gear 87, and second driving force transmission gear 88) from the first bearing member 76 located inward of the supporting member 83 in terms of the lengthwise direction of the cartridge 20;

(f) the first bearing member removal process for removing the first bearing member 76 attached to the development unit main frame 27, from the development unit main frame 27;

(g) the development roller removal process for removing the development roller 25*a* from the development unit main frame 27;

(h) the development blade removal process for removing the development blade 23 for regulating the amount of developer that is allowed to remain adhered to the peripheral surface of the development roller 25*a*, from the development unit main frame 27;

(i) the developer refill process for refilling the developer storage portion (toner container 27*b*) with developer, through the developer delivery hole 71*g* exposed by the removal of the development blade 23;

(j) the development blade attachment process for attaching the development blade 23 to the development unit main frame 27;

(k) the development roller attachment process for attaching the development roller 25*a* to the development unit main frame 27 by fitting the second end portion 25*a*2 of the shaft of the development roller 25*a* into the hole 75*a* of the second bearing member 75 attached to the development unit main frame 27, fitting the first end portion 25*a*1 of the shaft of the development roller 25*a* into the hole 76*a* of the first bearing member 76, and attaching the bearing member 76 to the development unit main frame 27;

(l) the second gear group attachment process for attaching the second group of gears (toner supply roller gear 86, first driving force transmission gear 87, and second driving force transmission gear 88) to the first bearing member 76 attached to one of the lengthwise ends of the development unit main frame 27;

(m) the supporting member attachment process for attaching the regulating member 83 to the first bearing member 76, to which the second group of gears is attached, in such a manner that the regulating member 83 at least partially overlaps with the second group of gears (toner supply roller gear 86, first driving force transmission gear 87, and second driving force transmission gear 88), and also, that the regulating member 83 is positioned outward of the second group of gears (toner supply roller gear 86, first driving force transmission gear 87, and second driving force transmission gear 88) in terms of the lengthwise direction of the development unit main frame 27;

(n) the first gear group attachment process for attaching the first group of gears (driving force reception gear 84 and development roller gear 85) to the first bearing member 76, to which the regulating member 83 has been attached, in such a manner that the first group of gears is positioned outward of the supporting member 83 in terms of the lengthwise direction of the development unit main frame 27;

(o) the first end cover attachment process for attaching the first end cover 82 to the first bearing member 76, with the interposition of the supporting member 83, so that a part of the end cover 82 is placed in contact with the supporting member 83 in a manner to keep the supporting member 83 (regulating member) pressed on the bearing member 76, with the first end cover 82 being accurately positioned relative to the first bearing member 76 by the fitting of the positioning projections 76*h* and 76*i* of the first bearing member 76 into the positioning holes 82*a* and 82*b* of the first end cover 82; and (p) the photosensitive drum unit and development unit connection process for connecting the photosensitive drum unit 20A and development unit 20B in such a manner that the two units are rotatable about the axial lines of the members connecting the two units.

The employment of the above described processes, and the structural arrangement having the supporting member 83, prevents the second group of gears from accidentally falling off during the disassembly and assembly of the development unit 20B, eliminating the need for restricting the attitude of the process cartridge when disassembling or assembling the process cartridge. Therefore, it is possible to simplify the method for remanufacturing a process cartridge.

Further, the toner container 27*b* can be refilled with toner, without removing the developer supply roller 25*b* from the development unit main frame 27. However, according to the above descried processes and structural arrangement, before the toner container 27*b* is refilled with toner, the development supply roller 25*b* for supplying the development roller 25*a* with developer is removed from the development unit main frame 27, more widely exposing the developer delivery hole 71*g*. Therefore, the toner container 27*b* can be more efficiently refilled with toner.

Further, the developer supply roller removal process comprises: the second end cover removal process for removing the screw 99 and removing the second end cover 81 attached to the second lengthwise end of the development unit 20B, and the second bearing member removal process for removing the screws 97 and 98 and removing the second bearing member 75 attached to the second lengthwise end of the development unit main frame 27. Therefore, it is possible to remove the development supply roller 25*b*, without component damage.

Further, according to the developer supply roller removal process in accordance with the present invention, before removing the development supply roller 25*b* from the development unit main frame 27, the end seal 100 pasted to the second lengthwise end of the development unit main frame 27 is completely peeled away, or it is partially peeled and the peeled portion is kept turned over. Then, the bushing 80 relatively loosely fitted around the second end portion 25*b*2 of the shaft of the development supply roller 25*b*, at the second lengthwise end of the development unit main frame 27, is removed. Then, the first end portion 25*b*1 of the shaft of the development supply roller 25*b* is pulled out of the hole 71*p* of the first lengthwise end portion of the development unit main frame 27, in order to remove the development supply roller 25*b* from the development unit main frame 27. Therefore, it is possible to remove the development supply roller 25*b* without component damage.

Given above is the summary of the essential processes in the cartridge remanufacturing method in accordance with the present invention. However, the above described processes are the processes in only one of the various process cartridge remanufacturing methods in accordance with the present invention. In other words, the procedures and methods in the above described embodiments of the present invention are not intended to limit the scope of the present invention. The following are the supplements to the above descriptions of the embodiments of the present invention, given to assure that the process cartridge remanufacturing method in accordance with the present invention is correctly understood.

A given development blade removed from a development unit is not always reattached to the development unit from which it was removed, and a given development unit separated from a cleaning unit is not always reunited with the cleaning unit from which it was separated. In other words, when the process cartridge remanufacturing processes are carried out using a manufacturing line, that is, so-called assembly line, or the like, after several development blades are removed from development units, they are placed in a tote box or the like, are cleaned with compressed air or the like, and then, are brought to the assembly line for reattachment. Therefore, they are not always reattached to the same development units from which they were removed. In addition, as long as they are the same in specifications, they are the same in shape, allowing that they may be slightly different in dimensions because of tolerance. Therefore, the development blades do not need to be always reattached to the development units from which they were removed. This also applies to the development roller unit. Also for the same reason, a given development unit is not, or does not need to be, always reconnected to the cleaning unit from which it was disconnected.

Obviously, each process in the process cartridge remanufacturing methods in the above described embodiments of the present invention may be automated with the use of a single or multiple robots if possible.

The above described process cartridge remanufacturing methods in the preceding embodiments of the present invention includes a process cartridge remanufacturing method comprising: a process for disassembling a single recovered used process cartridge; a process for sorting the components removed from the cartridge; and a process for manufacturing the process cartridge, using the sorted components from the single cartridge, or addition of brand-new components (unused components) if necessary, and a process cartridge remanufacturing method comprising: a process for disassembling multiple recovered used process cartridges; process for sorting the components removed from the multiple cartridges; and a process for manufacturing multiple process cartridges, using the sorted components from the same process cartridge from which they are removed, or the addition of brand-new components (unused components) or the sorted components from the process cartridges other than those from which they are removed, if necessary.

As described above, according to the present invention, a process cartridge can be easily remanufactured. Further, the second group of gears attached to the development unit of a process cartridge does not fall off when disassembling or reassembling the process cartridge. Further, when disassembling or assembling the process cartridge, there is virtually no need for restricting a process cartridge in attitude, improving therefore assembly efficiency.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 400822/2003 filed Nov. 28, 2003, which is hereby incorporated by reference.

What is claimed is:

1. A remanufacturing method for a process cartridge detachably mountable to a main assembly of an electrophotographic image forming apparatus, wherein the process cartridge includes a photosensitive drum unit having an electrophotographic photosensitive drum, and a developing unit which has a developer accommodating portion supporting a developing roller for developing an electrostatic latent image formed on the electrophotographic photosensitive drum and for accommodating a developer for developing the electrostatic latent image using the developing roller, and which has a developer supply opening for supplying the developer accommodated in the developer accommodating portion to the developing roller, wherein the photosensitive drum unit and the developing unit are rotatably connected with each other, said method including:

(a) a unit separating step of separating the photosensitive drum unit and the developing unit from each other;

(b) a first side cover member dismounting step of dismounting a first side cover member mounted to one longitudinal end of the developing unit;

(c) a first gear group dismounting step of dismounting a first gear group from a first bearing member mounted to one longitudinal end of a developing device frame on which the developing roller is mounted, wherein the first gear group includes a driving force receiving gear for receiving a driving force from the main assembly of the image forming apparatus when the process cartridge is mounted to the main assembly of the image forming apparatus;

(d) a supporting member dismounting step of dismounting a supporting member from the first bearing member after said first gear group dismounting step, wherein the supporting member is provided between the first gear group and a second gear group to support the second gear group, and wherein the second gear group is disposed at a position inside the driving force receiving gear with respect to a longitudinal direction of the developing device frame to transmit a driving force received by the driving force receiving gear to a developer supply roller for supplying the developer to the developing roller, wherein the supporting member is locked with an elastically deformable locking claw provided on the first bearing member, and the supporting member is removed from the first bearing member by deforming the locking claw after removing said first gear group;

(e) a second gear group dismounting step of dismounting the second gear group from the first bearing member;

(f) a first bearing member dismounting step of dismounting the first bearing member mounted to the developing device frame from the developing device frame;

(g) a developing roller dismounting step of dismounting the developing roller from the developing device frame;

(h) a developing blade dismounting step of dismounting, from the developing device frame, a developing blade for regulating an amount of the developer deposited on a peripheral surface of the developing roller;

(i) a developer refilling step of filling a developer into the developer accommodating portion through the developer supply opening exposed by the developing blade dismounting step;

(j) a developing blade mounting step of mounting the developing blade to the developing device frame;

(k) a developing roller mounting step of mounting the developing roller to the developing device frame by mounting the first bearing member to the developing device frame by engaging a one-end shaft to be provided at one longitudinal end of the developing roller in a first hole of the first bearing member and by engaging another end shaft to be provided at another longitudinal end of the developing roller in a second hole of a second bearing member mounted to another longitudinal end of the developing device frame;

(l) a second gear group mounting step of mounting the second gear group to the first bearing member mounted to the one longitudinal end of the developing device frame;

(m) a supporting member mounting step of mounting the supporting member to the first bearing member mounted to the second gear group at a position outside of the second gear group with respect to a longitudinal direction of the developing device frame so as to be overlapped with at least a part of the second gear group, wherein the supporting member is positioned relative to the first bearing member by engaging the supporting member with a positioning projection provided on the first bearing member, an engaging hole provided in the supporting member and an end of a gear shaft for rotatably supporting the second gear group are engaged with each other, and the supporting member is locked with the engaging claw, thus mounting the supporting member on the first bearing member;

(n) a first gear group mounting step of mounting the first gear group to the first bearing member to which the supporting member is mounted at a position outside supporting member with respect to a longitudinal direction of the developing device frame;

(o) a first side cover member mounting step of mounting the first side cover member to the first bearing member so as to interpose the supporting member therebetween and so as to partly contact the supporting member to confine the supporting member to the first bearing member, wherein the first side cover member is engaged with a positioning projection provided on the first bearing member to determine a mounting position relative to the first bearing member; and (p) a unit coupling process of rotatably connecting the photosensitive drum unit and the developing unit with each other.

2. A method according to claim 1, further comprising a developer supply roller dismounting step of dismounting the developer supply roller from the developing device frame prior to said developer refilling step.

3. A method according to claim 2, wherein the developer supply roller dismounting step includes, a second side cover member dismounting step of dismounting a second side cover member mounted to another longitudinal end of the developing unit, and a second bearing member dismounting step of dismounting the second bearing member mounted to the another longitudinal end of the developing device frame from the developing device frame.

4. A method according to claim 3, wherein in dismounting the developer supply roller from the developing device frame in the developer supply roller dismounting step, an end seal mounted to the another longitudinal end of the developing device frame is peeled off, or is partly turned up, and then a bush mounted to the another end of the developing device frame so as to be loosely engaged with the another end shaft of the developer supply roller, is dismounted, and the one-end shaft provided at one longitudinal end of the developer supply roller is pulled out of a hole provided in the one longitudinal end of the developing device frame, thus taking the developing roller out of the developing device frame.

5. A method according to claim 1, wherein in said supporting member mounting step, the supporting member is elastically locked with a locking portion provided in a locking hole of the supporting member.

6. A method according to claim 1, further comprising a stirring member gear mounting step of mounting a stirring member gear for transmitting a driving force received from the main assembly of the apparatus to a stirring member for stirring the developer accommodated in developer accommodating portion at one longitudinal end of the developing device frame, prior to said developing roller mounting step.

7. A method according to claim 1, wherein the first gear group dismounting step includes:

a driving force receiving gear dismounting step of dismounting the driving force receiving gear from the first bearing member; and a developing roller gear dismounting step of dismounting, from one end of the developing roller, a developing roller gear for transmitting a driving force received by the driving force receiving gear to the developing roller.

8. A method according to claim 1, wherein the second gear group dismounting step includes:

a driving force transmission gear dismounting step of dismounting, from the first bearing member, a driving force transmission gear for transmitting a driving force received by the driving force receiving gear to the developer supply roller by engagement with another driving force transmission gear; and a developer supply roller gear dismounting step of dismounting, from one end of the developer supply roller, a developer supply roller gear for receiving the driving force from the driving force transmission gear and for transmitting the driving force received from the driving force transmitting gear to the developer supply roller.

9. A method according to claim 1, wherein said first gear group mounting step includes:

a driving force receiving gear mounting step of mounting the driving force receiving gear to the first bearing member; and a developing roller gear mounting step of mounting a developing roller gear for transmitting a driving force received by the driving force receiving gear to the developing roller.

10. A method according to claim 1, wherein said second gear group mounting step includes:

a first driving force transmission gear mounting step of mounting, to the first bearing member, a first driving force transmission gear for transmitting a driving force received by the driving force receiving gear to a stirring member and to the developer supply roller by engagement with the driving force receiving gear;

a second driving force transmission gear mounting step of mounting, to the first bearing member, a second driving force transmission gear for transmitting a driving force received by the driving force receiving gear to the developer supply roller by engagement with the first driving force transmission gear; and a developer supply roller gear mounting step of mounting, to one end of the developer supply roller, a developer supply roller gear for receiving the driving force from the second driving force transmission gear and for transmitting the driving force received from the second driving force transmitting gear to the developer supply roller.

11. A method according to claim 1, wherein in said developer refilling step, the developer is supplied through the developer supply opening using a funnel.

* * * * *